US012601068B2

(12) United States Patent
Goto et al.

(10) Patent No.: US 12,601,068 B2
(45) Date of Patent: Apr. 14, 2026

(54) METHOD FOR MANUFACTURING CARBON MONOXIDE OR ORGANIC COMPOUND

(71) Applicants: THE DOSHISHA, Kyoto (JP); DAIKIN INDUSTRIES, LTD., Osaka (JP)

(72) Inventors: Takuya Goto, Kyotanabe (JP); Jinichi Koue, Kyotanabe (JP); Yuta Suzuki, Kyotanabe (JP); Kentaro Kozasa, Kyotanabe (JP); Saya Nozaki, Kyotanabe (JP); Shoma Tchorap-Yamamoto, Kyotanabe (JP); Tomohiro Isogai, Osaka (JP); Yosuke Kishikawa, Osaka (JP); Akiyoshi Yamauchi, Osaka (JP)

(73) Assignees: THE DOSHISHA, Kyoto (JP); DAIKIN INDUSTRIES, LTD., Osaka (JP)

( * ) Notice: Subject to any disclaimer, the term of this patent is extended or adjusted under 35 U.S.C. 154(b) by 81 days.

(21) Appl. No.: 18/448,264

(22) Filed: Aug. 11, 2023

(65) Prior Publication Data

US 2023/0383423 A1 Nov. 30, 2023

Related U.S. Application Data

(63) Continuation of application No. PCT/JP2022/005415, filed on Feb. 10, 2022.

(30) Foreign Application Priority Data

Feb. 12, 2021 (JP) ..... 2021-021298
Nov. 16, 2021 (JP) ..... 2021-186458

(51) Int. Cl.
*C25B 3/26* (2021.01)
*C25B 3/03* (2021.01)
(Continued)

(52) U.S. Cl.
CPC ..... *C25B 3/26* (2021.01); *C25B 3/03* (2021.01); *C25B 3/07* (2021.01); *C25B 11/042* (2021.01)

(58) Field of Classification Search
None
See application file for complete search history.

(56) References Cited

U.S. PATENT DOCUMENTS

2014/0093799 A1 4/2014 Masel et al.
2022/0380916 A1 12/2022 Kitagawa et al.

FOREIGN PATENT DOCUMENTS

CN 103205773 A 7/2013
CN 104822861 A 8/2015
(Continued)

OTHER PUBLICATIONS

F. Li et al. / Chinese Journal of Chemical Engineering 31 (2021) 75-93 (Year: 2021).*
(Continued)

*Primary Examiner* — Wojciech Haske
(74) *Attorney, Agent, or Firm* — Sughrue Mion, PLLC

(57) ABSTRACT

A method for manufacturing carbon monoxide or an organic compound, which includes electrolytically reducing carbon dioxide to obtain carbon monoxide or an organic compound in an electrolytic reduction apparatus having an anode, a cathode, and an electrolytic solution containing carbon dioxide. Carbon dioxide is selectively reduced into carbon monoxide or a specific organic compound by a potential to be applied to between the anode and the cathode.

16 Claims, 12 Drawing Sheets

(51) Int. Cl.
*C25B 3/07* (2021.01)
*C25B 11/042* (2021.01)

(56) References Cited

FOREIGN PATENT DOCUMENTS

| | | | | |
|---|---|---|---|---|
| JP | 2004-176129 | A | 6/2004 | |
| JP | 2010-18840 | A | 1/2010 | |
| JP | 2020-45527 | A | 3/2020 | |
| WO | WO-2016178590 | A1 * | 11/2016 | ..... C25B 1/00 |

OTHER PUBLICATIONS

International Preliminary Report on Patentability mailed Aug. 24, 2023 with translation of the Written Opinion in International Application No. PCT/JP2022/005415.
Y. Hori, "Handbook of fuel cells: fundamentals technology and applications", $CO_2$-reduction, catalyzed by metal electrodes, 2010, pp. 720-733, vol. 2, Chapter 48.
Y. Hori et al., "Production of Methane and Ethylene in Electrochemical Reduction of Carbon Dioxide at Copper Electrode in Aqueous Hydrogencarbonate Solution", Chem.Lett. 15, 1986, pp. 897-898.
P. K. Jiwanti et al., "The electrochemical production of C2/C3 species from carbon dioxide on copper-modified boron-doped diamond electrodes", Electrochim. Acta, 2018, pp. 414-419, 266.
Y. Song et al., "Enhanced Ethanol Production from CO2 Electroreduction at Micropores in Nitrogen-Doped Mesoporous Carbon", ChemSusChem, 2020, pp. 293-297, 13.
Yongchun Fu et al., "Surface Structure Sensitivity of $CO_2$ Electroreduction on Low-Index Gold Single Crystal Electrodes in Ionic Liquids", ChemElectroChem, 2018, pp. 748-752, 5.
Amanuel Lailu et al., "Efficient Electrocatalytic Reduction of Carbon Dioxide in 1-Ethyl-3-methylimidazolium Trifluoromethanesulfonate and Water Mixtures", Energy & Fuels, 2018, p. 12695-p. 12702.
Toshi Oguma et al., "Improvement of Electrochemical Reduction of $CO_2$ Using the Potential-Pulse Polarization Method", Electrochemistry, 2020, pp. 451-456.
Deonildo Faggion Jr. et al., "$CO_2$ Electroreduction in Ionic Liquids", frontiers in Chemistry, 2019, 8 pages.
Devjyoti Nath et al., "Solubility of carbon dioxide ($CO_2$) in four bis (trifluoromethyl-sulfonyl) imide ([$Tf_2N$]) based ionic liquids", Fluid Phase Equilibria, 2020, pp. 1-12.
Hiroyuki Tateno et al., "Electrochemical Fixation of $CO_2$ to organohalides in room-temperature ionic liquids under supercritical $CO_2$", Electrochimica Acta, 2015, pp. 212-217.
International Search Report of PCT/JP2022/005415 dated Mar. 29, 2022 [PCT/ISA/210].
Extended European Search Report dated Jan. 31, 2025 from the European Patent Office in Application No. 22752829.6.

* cited by examiner

METHOD FOR MANUFACTURING CARBON MONOXIDE OR ORGANIC COMPOUND

CROSS REFERENCE TO RELATED APPLICATIONS

This application is a Rule 53(b) Continuation of PCT Application No. PCT/JP2022/005415 filed on Feb. 10, 2022, claiming priority based on Japanese Patent Application No. 2021-021298 filed on Feb. 12, 2021 and Japanese Patent Application No. 2021-186458 filed on Nov. 16, 2021, the respective disclosures of which are incorporated herein by reference in their entirety.

TECHNICAL FIELD

The present disclosure relates to a method for manufacturing carbon monoxide or an organic compound.

BACKGROUND ART

The development of a technique related to carbon recycle which regards carbon dioxide as a carbon resource and involves recovering and recycling it as diverse carbon compounds has been demanded as a measure against recent global warming.

As for such a technique, it has been reported that a potential is applied to between an anode and a cathode in an aqueous solution of an inorganic electrolyte so that carbon dioxide can be electrolytically reduced to obtain lower hydrocarbon, a lower alcohol, a lower organic acid, or the like (see Non Patent Literature 1). It has also been reported that in a state where carbon dioxide is dissolved into an aqueous $KHCO_3$ solution by bubbling, carbon dioxide can be electrolytically reduced using a Cu electrode as a cathode and a Pt electrode as an anode to obtain methane or ethylene (see Non Patent Literature 2). Meanwhile, there is disclosed a method for manufacturing ethylene by using a Cu electrode coated with cuprous hydride in advance as a cathode and electrolytically reducing carbon dioxide (see Patent Literature 1).

It has been reported that in a state where carbon dioxide is dissolved into an aqueous KCl solution by bubbling, carbon dioxide can be electrolytically reduced using a "copper-modified boron-doped diamond electrode" as a cathode and a Pt electrode as an anode to obtain acetone and acetaldehyde together with ethanol, wherein the "copper-modified boron-doped diamond electrode" is obtained by electrodepositing Cu nanoparticles in an aqueous copper sulfate solution onto boron-doped diamond prepared with a microwave plasma CVD apparatus (see Non Patent Literature 3).

It has been reported that in a state where carbon dioxide is dissolved into an aqueous $KHCO_3$ solution by bubbling, carbon dioxide can be electrolytically reduced using a cathode and a Pt electrode as an anode to obtain ethanol, wherein the cathode is obtained by mixing conductive carbon, PVDF (polyvinylidene fluoride resin), and N-methyl-2-pyrrolidone, well dissolving or dispersing the mixture, applying the resulting slurry onto a carbon paper, drying the paper in vacuum overnight at 80° C. at 0.5 mTorr, and applying thereto an ultrasonic dispersion of "nitrogen-doped ordered mesoporous carbon" (a method for preparing the catalyst is omitted) in a solution of Nafion (tetrafluoroethylene-perfluoroalkylsulfonic acid copolymer, trademark of The Chemours Company) in ethanol (see Non Patent Literature 4).

It has been reported that in a state where carbon dioxide is dissolved into 1-butyl-3-methylimidazolium tetrafluoroborate which is an imidazolium-based ionic liquid by bubbling, carbon dioxide can be electrolytically reduced using a Au electrode as a cathode and a Pt electrode as an anode to obtain carbon monoxide (see Non Patent Literature 5).

CITATION LIST

Patent Literature

Patent Literature 1: JP-2004-176129 A

Non Patent Literature

Non Patent Literature 1: Yoshio Hori, Handbook of fuel cells: fundamentals technology and applications. Volume 2, Chapter 48, 720-733 (2010)

Non Patent Literature 2: Y. Hori et al., Chem. Lett. 15, 897-898 (1986)

Non Patent Literature 3: Jiwanti et al., Electrochim. Acta, 266, 414-419 (2018)

Non Patent Literature 4: Y. Song et al., ChemSusChem, 13, 293-297 (2020)

Non Patent Literature 5: Yongchun Fu et al., ChemElectroChem, 5, 748-752 (2018)

SUMMARY

A method for manufacturing carbon monoxide or an organic compound, comprising electrolytically reducing carbon dioxide to obtain carbon monoxide or an organic compound in an electrolytic reduction apparatus having an anode, a cathode, and an electrolytic solution containing carbon dioxide, wherein carbon dioxide is selectively reduced into carbon monoxide or a specific organic compound by a potential to be applied to between the anode and the cathode.

Advantageous Effects

The electrolytic reduction method of the present disclosure can manufacture carbon monoxide or an organic compound by efficiently reducing carbon dioxide at a low cost.

DESCRIPTION OF EMBODIMENTS

Figure 1:
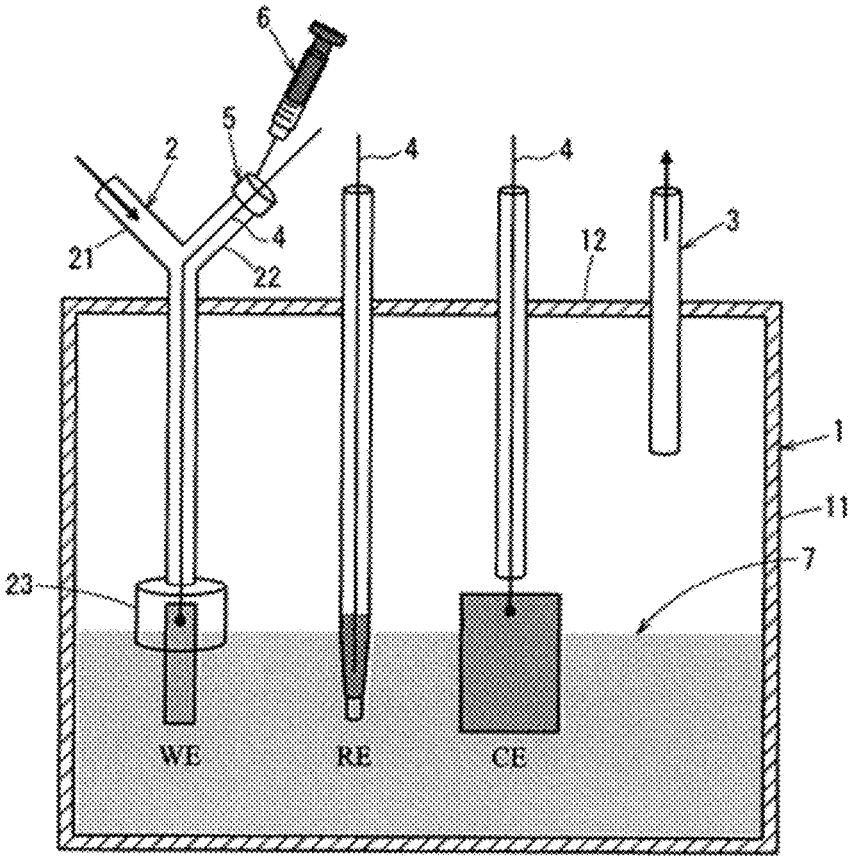
FIG. 1 is a diagram schematically showing an experiment apparatus used in an experiment.

Hereinafter, the present disclosure will be described in detail.

The present disclosure provides a method for manufacturing carbon monoxide or an organic compound by electrolytically reducing carbon dioxide in an electrolytic reduction apparatus having an anode, a cathode, and an electrolytic solution containing carbon dioxide, and this electrolytic reduction apparatus.

The electrolytic reduction is usually performed in an electrolyzer. For example, the electrolyzer may be of single-chamber type, double-chamber type, PEM type (solid polymer membrane type), flow type, or a bipolar type.

The electrolytic reduction apparatus for use in the electrolytic reduction method has an anode, a cathode, and an electrolytic solution containing carbon dioxide. The anode and the cathode are arranged in at least partial contact with the electrolytic solution. In the apparatus, a potential is applied to between the anode and the cathode, whereby carbon dioxide is reduced into an organic compound in the cathode, causing the flow of current.

Examples of the anode include, but are not limited to, Pt, conductive metal oxide, glassy carbon, and boron-doped diamond electrodes. The conductive metal oxide electrode may be, for example, a transparent conductive electrode, called ITO electrode, prepared by the film formation of a mixed oxide of indium and tin on glass, or an electrode, called DSA electrode (trademark of De Nora Permelec Ltd.), prepared by the film formation of an oxide of a platinum group metal such as ruthenium or iridium on a substrate of titanium or the like.

In a preferred embodiment, the anode can be a Pt electrode. Use of a Pt electrode as the anode improves the efficiency of electrolytic reduction and permits stable electrolytic reduction over a long period.

Examples of the cathode include, but are not limited to, electrodes of Ag, Cu, Ni, Pb, Hg, Tl, Bi, In, Sn, Cd, Au, Zn, Pd, Ga, Ge, Ni, Fe, Pt, Pd, Ru, Ti, Cr, Mo, W, V, Nb, Ta, and Zr, and alloys thereof, and electrodes of carbon materials such as glassy carbon, pyrolytic graphite, plastic formed carbon, and conductive diamond.

In a preferred embodiment, the cathode can be a Cu, Ag, or Fe electrode, more preferably a Cu electrode. Use of a Cu electrode as the cathode improves the efficiency of electrolytic reduction and enables the carbon monoxide or the organic compound of interest to be manufactured at smaller energy.

In a more preferred embodiment, the anode can be a Pt electrode, and the cathode can be a Cu, Ag, or Fe electrode. Use of a Pt electrode as the anode and a Cu electrode as the cathode improves the efficiency of electrolytic reduction and enables the carbon monoxide or the organic compound of interest to be manufactured at smaller energy.

In one embodiment, the cathode is a Cu electrode.

In an alternative embodiment, the cathode is a Ag electrode.

In an alternative embodiment, the cathode is an Fe electrode.

In a preferred embodiment, the anode and/or the cathode is a plate-shaped electrode. Preferably, the cathode is a plate-shaped electrode. More preferably, both the anode and the cathode are plate-shaped electrodes.

In one embodiment, the electrolytic solution comprises an ionic liquid.

In one embodiment, the content of water in the electrolytic solution is 5% by mass or less, preferably 3% by mass or less, more preferably 1% by mass or less, further preferably 0.1% by mass or less and, particularly, can be substantially 0% by mass. Such a small content of water in an electrolyte can suppress compositional change caused by the evaporation of water in the electrolyte and enables electrolysis to be continued over a long period without performing maintenance.

In an alternative embodiment, the electrolytic solution comprises at least an ionic liquid and water. In the electrolytic solution comprising an ionic liquid and water, water and carbon dioxide are electrolytically reduced at the same time on cathode surface, and the production of an organic compound progresses efficiency without supplying a hydrogen gas from the outside. In this context, the ionic liquid means a salt having a melting point of 100° C., i.e., an ionic substance consisting of a cationic moiety and an anionic moiety.

Preferably, the ionic liquid can specifically be an ionic liquid having a melting point of 100° C. or lower, preferably 40° C. or lower, further preferably 20° C. or lower. Use of the ionic liquid having a melting point of 100° C. or lower permits efficient electrolytic reduction at ordinary temperature and eliminates the need of heating the electrolytic solution during electrolytic reduction. Since an ionic liquid having a low melting point has a low viscosity and a high electric conductivity (ionic conductivity), electrolysis voltage can be low in the case of electrolysis at the same current value. Therefore, yields and energy efficiency can be enhanced per unit time.

In this context, the ionic liquid can specifically be an ionic liquid having a viscosity of 1,000 mPa·s or less, preferably 300 mPa·s or less, further preferably 300 mPa·s or less, at 25° C. The ionic liquid can specifically be an ionic liquid having a viscosity of 0.1 $mS \cdot s^{-1}$ or more, preferably 1 $mS \cdot s^{-1}$ or more, further preferably 10 $mS \cdot s^{-1}$ or more, at 25° C.

The ionic liquid desirably has a wide potential window, i.e., high redox resistance. The electrolytic reduction can be efficiently carried out for a long time by using an ionic liquid that is stable against oxygen generation reaction in the anode and the reduction reaction of carbon dioxide and water in the cathode in the present manufacturing method. The redox resistance is evaluated by cyclic voltammetry and can be defined on the basis of a potential window, i.e., a potential range in which substantially no current flows. Specifically, the ionic liquid can have a potential window of −2 V or less, preferably −2.5 V or less, further preferably 3 V or less, based on a silver/silver chloride reference electrode (the same holds true for the description below) on the reduction side. Specifically, the ionic liquid can have a potential window of 2 V or more, preferably 2.5 V or more, on the oxidation side. In the case of carrying out electrolysis in a range that falls outside the potential window, the ionic liquid is decomposed and causes a problem of difficulty in continuing electrolysis for a long period. However, a cathode potential differs in optimum set value depending on compositional features of the electrolytic solution and the product of interest. Therefore, the ionic liquid can be an ionic liquid that causes substantially no flow of current by energization in an argon atmosphere without introducing carbon dioxide at the optimum set value.

The ionic liquid can be appropriately selected in light of the product of interest, operating conditions, etc. from the viewpoint described above and from the viewpoint of the melting point, the viscosity, the electric conductivity (ionic conductivity), and the potential window. The type of the ionic liquid is not limited to those listed herein.

The ionic liquid desirably has high carbon dioxide solubility. Use of the ionic liquid having high carbon dioxide solubility enables electrolytic reduction to be carried out with higher efficiency.

Examples of the ionic liquid include an imidazolium-based ionic liquid, an aromatic ionic liquid, a pyrrolidinium-based ionic liquid, an ammonium-based ionic liquid, a piperidinium-based ionic liquid, and a quaternary phosphonium-based ionic liquid.

Examples of the imidazolium-based ionic liquid include, but are not limited to, hexyl-3-methylimidazolium bis(trifluoromethylsulfonyl)imide ($C_1C_6Im$-$NTf_2$), 1-butyl-3-methylimidazolium bis(trifluoromethylsulfonyl)imide ($C_1C_4Im$-$NTf_2$), 1-hexyl-2,3-dimethylimidazolium bis(trifluoromethylsulfonyl)imide ($C_1C_1C_6Im$-$NTf_2$), 1-butyl-2,3-dimethylimidazolium bis(trifluoromethylsulfonyl)imide ($C_1C_1C_4Im$-$NTf_2$), 1-ethyl-3-methylimidazolium bis(trifluoromethylsulfonyl)imide ($C_1C_2Im$]-$NTf_2$), 1-nonyl-3-methylimidazolium bis(trifluoromethylsulfonyl)imide ($C_1C_8Im$-$NTf_2$), 1-nonyl-2,3-dimethylimidazolium bis(trifluoromethylsulfonyl)imide ($C_1C_1C_8Im$-$NTf_2$), 1-propyl-2,3-dimethylimidazolium bis(trifluoromethylsulfonyl)imide ($C_1C_1C_3Im$-$NTf_2$), 1-ethyl-3-vinylimidazolium bis(trifluoromethylsulfonyl)imide (EVIm-$NTf_2$), 1,2-dimethyl-1-propylimidazolium bis(trifluoromethanesulfonyl)imide (DMPI-TFSI), 1,2-dimethyl-1-propylimidazolium tris(trifluoromethylsulfonyl)imide (DMPI-Me), 1-ethyl-3-methylimidazolium tetrafluoroborate (EMI-$BF_4$), 1-ethyl-3-methylimidazolium chloride (EMI-$C_1$), 1-ethyl-3-methylimidazolium bis(trifluoromethanesulfonyl)imide (EMI-TFSI), 1-ethyl-3-methylimidazolium bis((perfluoroethyl)sulfonyl)imide (EMI-BETI), 1-ethyl-3-methylimidazolium trifluoromethanesulfonate (EMI-TfO), 1-ethyl-3-methylimidazolium trifluoroacetate (EMI-TA), 1-ethyl-3-methylimidazolium 2.3 hydrogen fluoride (EMI-F$(HF)_{2.3}$), 1-ethyl-3-methylimidazolium bis(fluorosulfonyl)imide (EMI-FSI), 1-ethyl-3-methylimidazolium hexafluorophosphate (EMI-PF6), 1-butyl-3-methylimidazolium tetrafluoroborate (BMI-$BF_4$), 1-butyl-3-methylimidazolium trifluoroacetate (BMI-TA), 1-butyl-3-methylimidazolium hexafluorophosphate (BMI-$PF_6$), 1-butyl-3-methylimidazolium bis(trifluoromethanesulfonyl)imide (BMI-TFSI), 1-octyl-3-methylimidazolium bis(trifluoromethanesulfonyl)imide (C8MI-TFSI), 1-decyl-3-methylimidazolium bis(trifluoromethanesulfonyl)imide ($C_8$MI-TFSI), 1,2-dimethyl-3-propylimidazolium bis(trifluoromethanesulfonyl)imide (DMPI-TFSI), and 1,2-dimethyl-3-propylimidazolium bismethide (DMPI-Me).

Examples of the aromatic ionic liquid include, but are not limited to, diphenylmethane diisocyanate bis(trifluoromethanesulfonyl)imide (MDI-TFSI).

Examples of the ammonium-based ionic liquid include, but are not limited to, N,N-diethyl-N-(2-methoxyethyl)ammonium tetrafluoroborate (DEME-$BF_4$), trimethylpropylammonium bis(trifluoromethanesulfonyl)imide (TMPA-$(CF_3SO_2)_2N$), tetraethylammonium2,2,2-trifluoro-N-(trifluoromethylsulfonyl)acetamide (TEA-$CF_3CO$)$(CF_3SO_2)N$), N,N-diethyl-N-methyl-N-(2-methoxyethyl)ammonium bis(trifluoromethanesulfonyl)imide (DEME-TFSI), N,N-diethyl-N-methyl-N-(2-methoxyethyl)ammonium bis(trifluoromethylsulfonyl)imide (DEME-$NTF_2$), and N,N-diethyl-N-methyl-N-(2-methoxyethyl)ammonium bis(fluorosulfonyl)imide (DEME-FSI).

Examples of the pyrrolidinium-based ionic liquid include, but are not limited to, N-methyl-N-propylpyrrolidinium hexafluorophosphate ($P_{13}$-$PF_6$), N-methyl-N-propylpyrrolidinium bis(trifluoromethanesulfonyl)imide ($P_{13}$-TFSI), N-methyl-N-propylpyrrolidinium bis(fluorosulfonyl)imide ($P_{13}$-FSI), and N-methyl-N-methylpyrrolidinium bis(fluorosulfonyl)imide ($P_{14}$-FSI).

Examples of the piperidinium-based ionic liquid include, but are not limited to, N-propyl-N-methylpiperidinium bis(trifluoromethanesulfonyl)imide ([PMPip]$(CF_3SO_2)$2N).

Examples of the quaternary phosphonium-based ionic liquid include, but are not limited to, triethylpentylphosphonium bis(trifluoromethanesulfonyl)imide ($P_{2225}$TFSI), triethyloctylphosphonium bis(trifluoromethanesulfonyl)imide ($P_{2228}$-TFSI), tributylmethylphosphonium bis(trifluoromethanesulfonyl)imide ($P_{4441}$-TFSI), and triethylmethoxymethylphosphonium bis(trifluoromethanesulfonyl)imide ($P_{222\ (1O1)}$-TFSI).

In a preferred embodiment, the ionic liquid can be N,N-diethyl-N-(2-methoxyethyl)ammonium tetrafluoroborate (DEME-$BF_4$), or N,N-diethyl-N-methyl-N-(2-methoxyethyl)ammonium bis(trifluoromethanesulfonyl)imide (DEME-TFSI). The electrolytic reduction progresses efficiency over a longer time by using DEME-$BF_4$ or DEME-TFSI as the ionic liquid.

Only one of these ionic liquids may be used singly, or two or more thereof may be used in combination.

In one embodiment, the electrolytic solution consists of an ionic liquid and water.

The volume ratio between the ionic liquid and water in the electrolytic solution can be preferably 1:99 to 99:1, more preferably 5:95 to 95:5, further preferably 75:25 to 25:75, still further preferably 70:30 to 30:70, particularly preferably 60:40 to 40:60. When the volume ratio between the ionic liquid and water falls within the range described above, the electrolytic reduction progresses more efficiently.

In an alternative embodiment, the electrolytic solution can comprise an additive in addition to the ionic liquid and water.

Examples of the additive include a supporting electrolyte effective for enhancing the electric conductivity of the electrolytic solution, a basic catalyst, and an additive effective for enhancing the solubility of carbon dioxide in the electrolytic solution.

In one embodiment, the electrolytic solution consists of an ionic liquid, water, and a supporting electrolyte. The electrolytic reduction progresses stably and efficiently over a long time at a low cell voltage by using the electrolytic solution consisting of an ionic liquid, water, and a supporting electrolyte.

The supporting electrolyte is not limited and preferably contains a cation having a low or equivalent standard electrode potential that does not interfere with the electrolytic reduction of carbon dioxide or the electrolytic reduction of $H_2O$.

Examples of the supporting electrolyte include, but are not limited to, an alkali metal salt and an alkaline earth metal salt and specifically include $LiHCO_3$, $NaHCO_3$, $KHCO_3$, $CsHCO_3$, KCl, $KClO_4$, $K_2SO_3$, $KHPO_4$, $LiBF_4$, $LiPF_6$, $LiClO_4$, $LiAsF_6$, LiTf, LiTFSI, $Li(CF_3SO_2)_2N$, $K_2CO_3$, $Li_2CO_3$, and $Na_2CO_3$.

In a preferred embodiment, the supporting electrolyte can be $KHCO_3$. The electrolytic reduction progresses more efficiently by using $KHCO_3$ as the supporting electrolyte.

Only one of these supporting electrolytes may be used singly, or two or more thereof may be used in combination.

In a preferred embodiment, the combination of the ionic liquid and the supporting electrolyte can be a combination of DEME-$BF_4$ and $KHCO_3$.

The supporting electrolyte is preferably added as an aqueous solution. Its concentration in the aqueous solution can be preferably 0.01 to 10 mol/L, more preferably 0.01 to 5.0 mol/L, further preferably 0.05 to 0.5 mol/L. When the concentration of the supporting electrolyte in the aqueous solution falls within the range described above, the electrolytic reduction progresses more efficiently.

The volume ratio between the ionic liquid and water+supporting electrolyte (i.e., the aqueous solution of the supporting electrolyte) in the electrolytic solution can be preferably 75:25 to 25:75, more preferably 70:30 to 30:70, further preferably 60:40 to 40:60. When the volume ratio between the ionic liquid and water+supporting electrolyte falls within the range described above, the electrolytic reduction progresses more efficiently.

In one embodiment, the electrolytic solution consists of an ionic liquid, water, and a basic catalyst. The electrolytic reduction progresses efficiently by using the electrolytic solution consisting of an ionic liquid, water, and a basic catalyst.

Examples of the basic catalyst include a hydroxide of an alkali metal or an alkaline earth metal and specifically include LiOH, NaOH, KOH, RbOH, CsOH, $Be(OH)_2$, $Mg(OH)_2$, $Ca(OH)_2$, $Sr(OH)_2$, and $Ba(OH)_2$.

In a preferred embodiment, the basic catalyst can be $Ca(OH)_2$, LiOH, NaOH, KOH, or CsOH. The electrolytic reduction progresses more efficiently by using $Ca(OH)_2$, LiOH, NaOH, KOH, or CsOH as the basic catalyst. Since the basic catalyst is effective for enhancing the solubility of carbon dioxide in the electrolytic solution, the electrolytic reduction progresses more efficiently.

The content of the basic catalyst in the electrolytic solution can be preferably $1.0\times10^{-4}$ to 5.0 parts by mol, more preferably $1.0\times10^{-3}$ to 1.0 parts by mol, further preferably $5.0\times10^{-3}$ to 0.1 parts by mol, per 100 parts by mol in total of the ionic liquid and water. When the content of the basic catalyst falls within the range described above, the electrolytic reduction progresses more efficiently.

In one embodiment, the electrolyte comprises an ionic liquid, and the content of water is 5% by mass or less, preferably 3% by mass or less, more preferably 1% by mass or less, further preferably 0.1% by mass or less and, particularly, can be substantially 0% by mass. Too large a content of water disadvantageously markedly decreases the yield of the product of interest because hydrogen generation by the electrolytic reduction of water becomes principal reaction. Too small a content of water elevates the resistance value of the electrolytic solution and therefore decreases the total yield of products and furthermore decreases the yield of an organic compound containing hydrogen in the molecule. Hence, the optimum content of water needs to be maintained.

In one embodiment, the electrolyte is free of the additive.

In one embodiment, the electrolyte comprises an ionic liquid, has a content of water of 5% by mass or less, preferably 3% by mass or less, more preferably 1% by mass or less, further preferably 0.1% by mass or less, particularly, substantially 0% by mass, and is free of the additive.

The concentration of carbon dioxide in the electrolytic solution is not limited and is preferably a high concentration. The concentration can be, for example, a saturated concentration.

Examples of the method for dissolving carbon dioxide in the electrolytic solution include, but are not limited to, the bubbling of carbon dioxide into the electrolytic solution, a method of rendering carbon dioxide saturated in an electrolyzer containing the electrolytic solution, stirring using a stirring apparatus, stirring by ultrasonic application, and use of a flow electrolysis cell.

In the electrolytic reduction method of the present disclosure, carbon dioxide may be used in combination with an additional gas. Examples of the gas to be used in combination include argon, nitrogen, hydrogen, and water vapor.

The temperature of the electrolytic solution in performing the electrolytic reduction can be preferably 0 to 100° C., more preferably 0 to 80° C., further preferably 10 to 50° C., still further preferably 20 to 40° C. The temperature of the electrolytic solution that is around room temperature eliminates the need of providing a heating apparatus for the electrolytic solution and a cooling apparatus with a refrigerator and can keep apparatus and operating costs low. The temperature range of 40 to 100° C., which requires a simple heating apparatus, can reduce the viscosity of the electrolytic solution by heating and can therefore elevate conductivity (ionic conductivity). Hence, an electrolysis voltage can be low, and yields per unit time can be enhanced. In the electrolytic reduction method of the present disclosure, the electrolytic reduction progresses efficiently even at the temperature of the electrolytic solution set to the temperature range described above. Thus, an energy cost can be reduced.

The pressure in performing the electrolytic reduction can be preferably atmospheric pressure to 0.5 MPa, for example, 0.1 MPa to 0.5 MPa, more preferably 0.1 MPa to 0.3 MPa, further preferably 0.1 MPa to 0.2 MPa. In the electrolytic reduction method of the present disclosure, the electrolytic reduction progresses efficiently even under no pressure or small pressure. Thus, an energy cost can be reduced.

The potential of the cathode in performing the electrolytic reduction can be preferably −5.0 V to −1.5 V, more preferably −5.0 V to −2.0 V, further preferably −4.0 V to −2.0 V, still further preferably −3.0 V to −2.0 V, particularly preferably −2.7 V to −2.3 V. This potential is a potential when a $Ag^+/Ag$ electrode is used as a reference electrode. When the potential of the cathode falls within the range described above, the electrolytic reduction progresses more efficiently so that the compound of interest can be obtained at a good yield.

The electrolytic reduction method of the present disclosure reduces carbon dioxide to obtain carbon monoxide or an organic compound.

Examples of the organic compound include hydrocarbon and an organic compound consisting of carbon, hydrogen, and oxygen.

The hydrocarbon can be preferably hydrocarbon having 1 to 10 carbon atoms, more preferably hydrocarbon having 1 to 6 carbon atoms, further preferably hydrocarbon having 1 to 3 carbon atoms. For example, the hydrocarbon may be chained or cyclic, may be linear or branched, and may be saturated or unsaturated. In one embodiment, the hydrocarbon is chained. In an alternative embodiment, the hydrocarbon is cyclic.

In a preferred embodiment, the chained hydrocarbon can be methane, ethane, ethylene, propane, or propene.

In a preferred embodiment, for example, the cyclic hydrocarbon may be an alicyclic compound or may be an aromatic compound. Specifically, the cyclic hydrocarbon is cyclohexane, cycloheptane, benzene, toluene, or xylene, and can be particularly preferably toluene.

The organic compound consisting of carbon, hydrogen, and oxygen can be, for example, an ether, cyclic ether, alcohol, or carbonyl compound.

In a preferred embodiment, the organic compound consisting of carbon, hydrogen, and oxygen can be oxetanone, acetone, formaldehyde, or acetaldehyde having a hydrocarbon group having 1 to 3 carbon atoms (preferably a methyl group).

In a preferred embodiment, the organic compound consisting of carbon, hydrogen, and oxygen can be an alcohol, preferably an alcohol having 1 to 10 carbon atoms, more preferably an alcohol having 1 to 6 carbon atoms, further preferably an alcohol having 1 to 3 carbon atoms.

In one embodiment, the electrolytic reduction method of the present disclosure reduces carbon dioxide to obtain carbon monoxide. The conventional manufacture of carbon monoxide employs a special and expensive electrode material using metal nanoparticles or the like. The method of the present disclosure obtains faraday efficiency comparable to such an expensive electrode material even if an inexpensive copper plate or silver plate is used as it is without the use of the expensive electrode material. Therefore, electrolysis can be continued for a long time without performing maintenance. Furthermore, a total cost including a maintenance fee can be reduced. The electrolytic reduction method of the present disclosure can reduce carbon dioxide to obtain carbon monoxide even if an ionic liquid containing no aqueous solution is used in the electrolytic solution. The absence of the aqueous solution decreases the total yield of products due to high electrolytic solution resistance. However, use of an appropriate ionic liquid, for example, triethylpentylphosphonium bis(trifluoromethanesulfonyl)imide, enables electrolysis to be continued for a long time without being influenced by compositional change caused by the evaporation of water and without performing maintenance, while minimizing reduction in yield. Moreover, the method of the present disclosure eliminates the need of providing an apparatus for maintaining the compositional features of the electrolytic solution and can realize a small and inexpensive carbon dioxide decomposition apparatus.

In an alternative embodiment, the electrolytic reduction method of the present disclosure reduces carbon dioxide to obtain an alcohol, preferably ethanol. A conventional method employs a special and expensive electrode material such as "nitrogen-doped ordered mesoporous carbon". The method of the present disclosure obtains faraday efficiency comparable to such an expensive electrode material even if an inexpensive silver plate is used as it is without the use of the expensive electrode material. Therefore, electrolysis can be continued for a long time without performing maintenance. Furthermore, a total cost including a maintenance fee can be reduced.

The electrolytic reduction method of the present disclosure can selectively electrolytically reduce carbon dioxide into a predetermined organic compound by adjusting a potential to be applied to between the anode and the cathode. For example, methane can be obtained by the application of a certain potential, and ethane can be obtained by the application of another potential.

Thus, the present disclosure also provides a method for electrolytically reducing carbon dioxide in an electrolytic reduction apparatus having an anode, a cathode, and an electrolytic solution containing carbon dioxide, wherein carbon dioxide is capable of being selectively electrically reduced into carbon monoxide or a predetermined organic compound by a potential to be applied to between the anode and the cathode.

For example, using a Cu electrode as the cathode, a Pt electrode as the anode, and a mixture of DEME-$BF_4$ and an aqueous $KHCO_3$ solution as the electrolytic solution, methane can be obtained by applying approximately −2.3 V to between the anode and the cathode; propene can be obtained by applying approximately −2.5 V thereto; and ethane and ethylene can be selectively obtained by applying approximately −2.7 V thereto.

As described above, the method for obtaining carbon monoxide or an organic compound by the electrolytic reduction of carbon dioxide according to the present disclosure has high efficiency of reduction of carbon dioxide into an organic compound, for example, high faraday efficiency. The faraday efficiency of electrolytic reduction in the method of the present disclosure can be preferably 10% or more, more preferably 15% or more, further preferably 20% or more.

The method of the present disclosure is also advantageous in terms of durability because processing at a high treatment, a complicated electrode form, other catalysts, and the like are unnecessary. For example, the method for manufacturing carbon monoxide or an organic compound, comprising electrolytically reducing carbon dioxide to obtain carbon monoxide or an organic compound, according to the present disclosure suppresses decrease in reduction efficiency even when operated for preferably 100 hours or longer, more preferably 150 hours or longer.

Although the present invention is described above, the present invention is not limited by those described above. Various changes or modifications can be made therein without departing from the spirit of the present invention.

The present disclosure includes the following embodiments.

[1] A method for manufacturing carbon monoxide or an organic compound, comprising electrolytically reducing carbon dioxide to obtain carbon monoxide or an organic compound in an electrolytic reduction apparatus having an anode, a cathode, and an electrolytic solution containing carbon dioxide, wherein carbon dioxide is selectively reduced into carbon monoxide or a specific organic compound by a potential to be applied to between the anode and the cathode.

[2] A method for manufacturing carbon monoxide or an organic compound, comprising electrolytically reducing carbon dioxide to obtain carbon monoxide or an organic compound in an electrolytic reduction apparatus having an anode, a cathode, and an electrolytic solution containing carbon dioxide, wherein the electrolytic solution comprises an ionic liquid.

[3] The method for manufacturing carbon monoxide or an organic compound according to [2], wherein the electrolytic solution further comprises water.

[4] The method for manufacturing carbon monoxide or an organic compound according to [2] or [3], wherein the ionic liquid is an imidazolium-based ionic liquid, an aromatic ionic liquid, a pyrrolidinium-based ionic liquid, an ammonium-based ionic liquid, a piperidinium-based ionic liquid, or a quaternary phosphonium-based ionic liquid.

[5] The method for manufacturing carbon monoxide or an organic compound according to any one of [2] to [4], wherein the ionic liquid is N,N-diethyl-N-(2-methoxyethyl)ammonium tetrafluoroborate or N,N-diethyl-N-methyl-N-(2-methoxyethyl)ammonium bis(trifluoromethanesulfonyl)imide.

[6] The method for manufacturing carbon monoxide or an organic compound according to any one of [2] to [5], wherein the electrolytic solution comprises an additive.

[7] The method for manufacturing carbon monoxide or an organic compound according to any one of [2] to [6], wherein the additive comprises a supporting electrolyte or a basic catalyst.

[8] The method for manufacturing carbon monoxide or an organic compound according to [7], wherein the supporting electrolyte is $KHCO_3$, $KHPO_4$, $LiBF_4$, $LiPF_6$, $LiClO_4$, $LiAsF_6$, LiTf, LiTFSI, $Li(CF_3SO_2)_2N$, $K_2CO_3$, $Li_2CO_3$, $Na_2CO_3$, or $NaHCO_3$.

[9] The method for manufacturing carbon monoxide or an organic compound according to [7] or [8], wherein the supporting electrolyte is $KHCO_3$.

[10] The method for manufacturing carbon monoxide or an organic compound according to any one of [3] to [9], wherein a volume ratio between the ionic liquid and the total of water and the supporting electrolyte is 1:99 to 99:1.

[11] The method for manufacturing carbon monoxide or an organic compound according to [7], wherein the basic catalyst is a hydroxide of an alkali metal or an alkaline earth metal.

[12] The method for manufacturing carbon monoxide or an organic compound according to [7] or [8], wherein the basic catalyst is $Ca(OH)_2$, LiOH, NaOH, KOH, or CsOH.

[13] The method for manufacturing carbon monoxide or an organic compound according to any one of [2] to [12], wherein the electrolytic reduction apparatus further comprises a reference electrode, the reference electrode is a $Ag^+/Ag$ electrode, and a potential of the cathode is −5.0 to −1.5 V.

[14] The method for manufacturing carbon monoxide or an organic compound according to any one of [2] to [13], wherein a temperature of the electrolytic solution is 0 to 100° C.

[15] The method for manufacturing carbon monoxide or an compound according to any one of [1] to [14], wherein the cathode is a plate electrode.

[16] The method for manufacturing carbon monoxide or an organic compound according to any one of [1] to [15], wherein the anode is a Pt, metal oxide, glassy carbon, or boron-doped diamond electrode, and the cathode is a Cu, Ag, Fe, or Ni electrode.

[17] The method for manufacturing carbon monoxide or an organic compound according to any one of [1] to [16], wherein the cathode is a Ag, Cu, or Fe electrode.

[18] The method for manufacturing carbon monoxide or an organic compound according to any one of [1] to [17], wherein the cathode is a Ag, Cu, or Fe electrode, and the anode is a Pt electrode.

[19] The method for manufacturing carbon monoxide or an organic compound according to any one of [1] to [18], wherein the organic compound is hydrocarbon or an organic compound consisting of carbon, hydrogen, and oxygen.

[20] The method for manufacturing carbon monoxide or an organic compound according to [19], wherein the hydrocarbon is $C_{1-10}$ hydrocarbon.

[21] The method for manufacturing carbon monoxide or an organic compound according to [19], wherein the organic compound consisting of carbon, hydrogen, and oxygen is an ether, cyclic ether, alcohol, or carbonyl compound.

[22] The method for manufacturing carbon monoxide or an organic compound according to any one of [2] to [21], wherein carbon monoxide or a predetermined organic compound is selectively produced by varying the potential of the cathode.

[23] An electrolytic reduction apparatus for manufacturing carbon monoxide or an organic compound from carbon dioxide by electrolytic reduction, the electrolytic reduction apparatus comprising an anode, a cathode, and an electrolyzer that accommodates an electrolytic solution containing carbon dioxide, wherein carbon dioxide is selectively reduced into carbon monoxide or a specific organic compound by a potential to be applied to between the anode and the cathode.

[24] The electrolytic reduction apparatus according to [22], wherein the cathode is a Ag, Cu, or Fe electrode.

[25] The electrolytic reduction apparatus according to [22] or [23], wherein carbon dioxide is selectively reduced into carbon monoxide.

[26] The electrolytic reduction apparatus according to any one of [22] to [24], wherein a content of water in the electrolytic solution is 5% by mass or less.

[27] The electrolytic reduction apparatus according to any one of [22] to [26], wherein the electrolytic solution is triethylpentylphosphonium bis(trifluoromethanesulfonyl)imide.

[28] An electrolytic reduction apparatus for manufacturing carbon monoxide or an organic compound from carbon dioxide by electrolytic reduction, the electrolytic reduction apparatus comprising an anode, a cathode, and an electrolytic solution containing carbon dioxide, wherein the electrolytic solution comprises an ionic liquid and water.

[29] The electrolytic reduction apparatus according to [28], wherein the ionic liquid is an imidazolium-based ionic liquid, an aromatic ionic liquid, a pyrrolidinium-based ionic liquid, an ammonium-based ionic liquid, a piperidinium-based ionic liquid, or a quaternary phosphonium-based ionic liquid.

[30] The electrolytic reduction apparatus according to [28] or [29], wherein the ionic liquid is N,N-diethyl-N-(2-methoxyethyl)ammonium tetrafluoroborate or N,N-diethyl-N-methyl-N-(2-methoxyethyl)ammonium bis(trifluoromethanesulfonyl)imide.

[31] The electrolytic reduction apparatus according to any one of [28] to [30], wherein the electrolytic solution comprises an additive.

[32] The electrolytic reduction apparatus according to [31], wherein the additive comprises a supporting electrolyte or a basic catalyst.

[33] The electrolytic reduction apparatus according to [32], wherein the supporting electrolyte is $KHCO_3$, $KHPO_4$, $LiBF_4$, $LiPF_6$, $LiClO_4$, $LiAsF_6$, LiTf, LiTFSI, $Li(CF_3SO_2)_2N$, $K_2CO_3$, $Li_2CO_3$, $Na_2CO_3$, or $NaHCO_3$.

[34] The electrolytic reduction apparatus according to [32] or [33], wherein the supporting electrolyte is $LiBF_4$.

[35] The electrolytic reduction apparatus for hydrocarbon according to any one of [28] to [34], wherein a volume ratio between the ionic liquid and the total of water and the supporting electrolyte is 75:25 to 25:75.

[36] The electrolytic reduction apparatus for hydrocarbon according to [32], wherein the basic catalyst is a hydroxide of an alkali metal or an alkaline earth metal.

[37] The electrolytic reduction apparatus for hydrocarbon according to [36], wherein the basic catalyst is $Ca(OH)_2$, LiOH, KOH, NaOH, or CsOH.

[38] The electrolytic reduction apparatus according to any one of [28] to [37], wherein the cathode is a plate electrode.

[39] The electrolytic reduction apparatus according to any one of [28] to [38], wherein the anode is a Pt, metal oxide, glassy carbon, or boron-doped diamond electrode, and the cathode is a Cu, Ag, Fe, or Ni electrode.

[40] The electrolytic reduction apparatus according to any one of [28] to [39], wherein the cathode is a Ag, Cu, or Fe electrode.

[41] The electrolytic reduction apparatus according to any one of [28] to [40], wherein the cathode is a Ag, Cu, or Fe electrode, and the anode is a Pt electrode.

EXAMPLES

Hereinafter, the present invention will be specifically described with reference to Examples given below. However, the present invention is not limited by these Examples.

FIG. 1 schematically shows an experiment apparatus used in the present Examples. The experiment apparatus has electrolyzer 1, carbon dioxide supply pipe 2, working electrode WE which is a cathode, counter electrode CE which is an anode, reference electrode RE, and exhaust pipe 3. The electrolyzer 1 has cell body 11 and lid 12 which closes the upper opening of the cell body 11. The working electrode WE is a plate electrode, housed in a glass bulkhead, and connected to conductor wire 4 made of Ni. The counter electrode CE is a Pt plate electrode and connected to conductor wire 4 made of Ni. The reference electrode RE is a $Ag^+/Ag$ electrode and connected to conductor wire 4 made of Ni. The gas feed pipe 2 has an upper part branched in a Y shape into two parts, first branched pipe part 21 and second branched pipe part 22, and both the branched pipe parts 21 and 22 protrude from the upper part of the lid 12. The gas feed pipe 2 has enlarged diameter part 23 in a cylindrical form disposed with an enlarged diameter at an end opposite to the branched pipe parts. The electrolyzer 1 contains electrolytic solution 7, and the working electrode WE, the counter electrode CE, and the reference electrode RE as well as the enlarged diameter part 23 is fixed in a state dipped in the electrolytic solution 7. The electrolytic solution was used at 25±2° C. unless otherwise specified.

Example 1

An ionic liquid DEME-$BF_4$ and an aqueous $KHCO_3$ solution (0.1 mol/L) were mixed at a volume ratio of 1:1 to obtain electrolytic solution A. The obtained electrolytic solution A was added into the cell body 11 of the electrolyzer 1 up to a height at which the respective electrodes WE, RE, and CE as well as the enlarged diameter part 23 was dipped in the electrolytic solution A, as shown in FIG. 1. The working electrode WE used was a Cu plate electrode. The electrolyzer 1 was sealed with the lid 12, and the working electrode WE, the reference electrode RE, and the counter electrode CE were connected to a potentiostat/galvanostat apparatus (manufactured by Bio-Logic Science Instruments Ltd.).

Carbon dioxide was supplied at a gas pressure of 0.1 MPa for 30 minutes into the gas feed pipe 2 via a carbon dioxide supply pipe (not shown) connected to the first branched pipe part 21, and carbon dioxide was bubbled into the electrolytic solution A in the electrolyzer 1 from the lower end of the gas feed pipe 2. Subsequently, the reduction behavior of carbon dioxide was observed by applying a potential to between the working electrode WE and the counter electrode CE at a scanning rate of 10 mV/s by cyclic voltammetry, and measuring a current density.

Comparative Example 1

The same operation as in Example 1 was performed except that Ar was used instead of carbon dioxide.

Comparative Example 2

The same operation as in Example 1 was performed except that DEME-$BF_4$ was used instead of electrolytic solution A.

Figure 2:
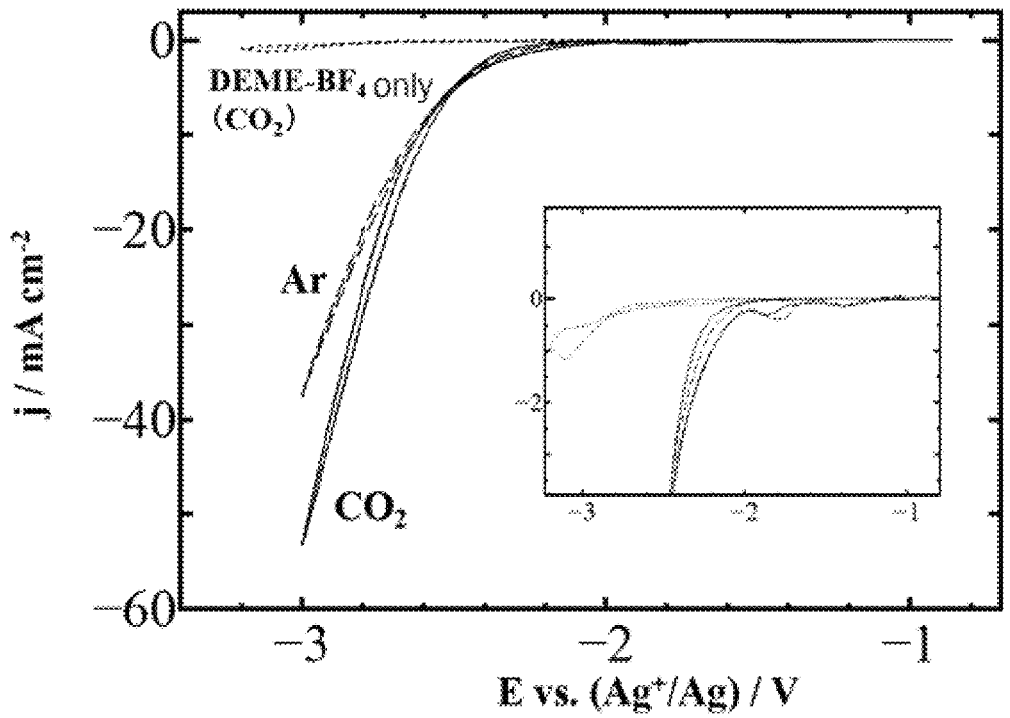
FIG. 2 is a cyclic voltammogram illustrating the reduction behavior of carbon dioxide during electrolytic reduction carried out using electrolytic solution A.

The results of Example 1 and Comparative Examples 1 and 2 are shown in the graph of FIG. 2. In the graph, the solid line depicts the results of Example 1, the broken line depicts the results of Comparative Example 1, and the dotted line depicts the results of Comparative Example 2. From FIG. 2, the electrolytic reduction of carbon dioxide was confirmed to progress in the potential window of DEME-$BF_4$. Specifically, reduction current in Comparative Example 2 using DEME-$BF_4$ alone as the electrolytic solution rose around −2.9 V, whereas reduction current in Example 1 in which carbon dioxide was introduced using the electrolytic solution A mixed with an aqueous $KHCO_3$ solution started to flow from around −2.0 V. Also, reduction current started to flow from around −2.0 V in Comparative Example 1 using Ar instead of carbon dioxide. These results indicate the generation of hydrogen by the reduction of $H_2O$ and suggest use thereof as a hydrogen source for a hydrocarbon gas according to the present invention. It is thus evident that the formation of a hydrocarbon gas by the electrolytic reduction of carbon dioxide progresses without being influenced by the reductive decomposition of DEME-$BF_4$.

Example 2

Experiment 1

Carbon dioxide was bubbled into the electrolytic solution A in the electrolyzer 1 in the same manner as in Example 1.

Then, the cathode potential was set to constant voltage of −2.1 V, and in this state, electrolysis was performed for 30 minutes. After the completion of electrolysis, a needle of syringe 6 was inserted into the first branched pipe part 21 from rubber stopper 5 of the second branched pipe part 22, and a gas in the gas feed pipe 2 was collected and subjected to gas chromatography analysis (carrier gas: nitrogen).

Experiment 2

Electrolysis was performed in the same manner as in Experiment 1 except that the cathode potential was set to constant voltage of −2.8 V. After the completion of electrolysis, a gas in the gas feed pipe 2 was collected and subjected to gas chromatography analysis (carrier gas: nitrogen) in the same manner as in Experiment 1.

Figure 3:
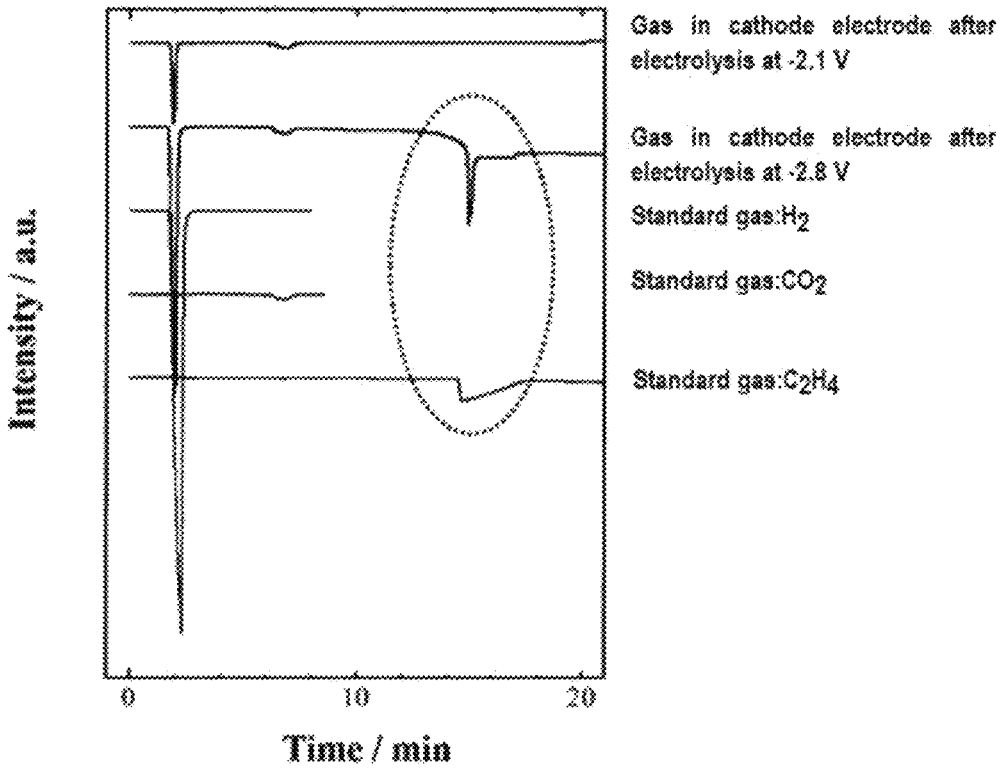
FIG. 3 is a diagram showing, in comparison with standard gases, a chromatogram obtained by the gas chromatography analysis of a gas generated on the cathode side during electrolytic reduction carried out using electrolytic solution A.

FIG. 3 shows chromatograms obtained by gas chromatography analysis in Experiments 1 and 2 described above, in comparison with chromatograms of hydrogen, carbon dioxide, and an ethylene gas serving as reference gases. As shown in FIG. 3, a peak at the same position as that of the peaks of hydrogen and carbon dioxide was found in Experiment 1 using −2.1 V as the cathode potential. On the other hand, a peak at the same position as that of the peaks of hydrogen and carbon dioxide as well as a peak at the same position as that of the peak of an ethylene gas was found in Experiment 2 using −2.8 V as the cathode potential. These results demonstrated that in electrolytic reduction using the electrolytic solution A, ethylene can be selectively obtained with high efficiency by adjusting the potential to be applied.

Example 3

An ionic liquid DEME-$BF_4$ and an aqueous $KHCO_3$ solution (0.1 mol/L) were mixed at a capacity ratio of 50:11 to obtain electrolytic solution B. The obtained electrolytic solution B was added to the electrolyzer 1 in the same manner as in Example 1, and carbon dioxide was bubbled thereinto. Subsequently, the reduction behavior of carbon dioxide was observed by applying a potential to between the working electrode WE and the counter electrode CE at a scanning rate of 10 mV/s by cyclic voltammetry, and measuring a current density.

Comparative Example 3

The same operation as in Example 4 was performed except that Ar was used instead of carbon dioxide.

Figure 4:
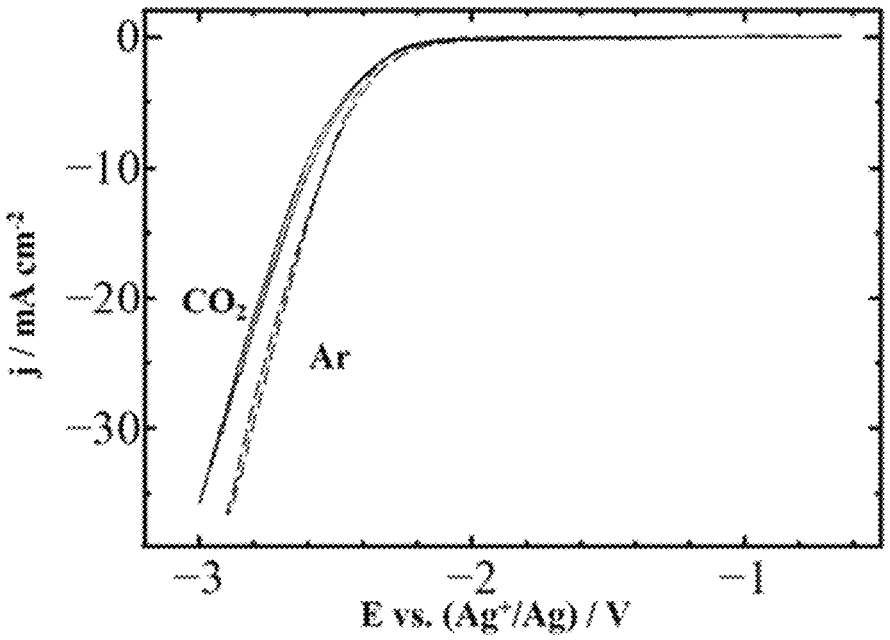
FIG. 4 is a cyclic voltammogram illustrating the reduction behavior of carbon dioxide during electrolytic reduction carried out using electrolytic solution B.

The results of Example 3 and Comparative Example 3 are shown in the graph of FIG. 4. In the graph, the solid line depicts the results of Example 3, and the broken line depicts the results of Comparative Example 3. From FIG. 4, the electrolytic reduction of carbon dioxide was also confirmed to progress at a potential lower than approximately −2.0 V in the electrolytic solution B. This potential indicates that the reduction of carbon dioxide progresses without being influenced by the reductive decomposition of DEME-$BF_4$, as in Example 1.

Example 4

Experiment 3

Carbon dioxide was bubbled into the electrolytic solution B in the electrolyzer 1 in the same manner as in Example 3. Then, the cathode potential was set to constant voltage of −1.9 V, and in this state, electrolysis was performed for 60 minutes. After the completion of electrolysis, a needle of syringe 6 was inserted into the first branched pipe part 21 from rubber stopper 5 of the first branched pipe part 21, and a gas in the gas feed pipe 2 was collected and subjected to gas chromatography analysis (carrier gas: nitrogen).

Experiment 4

Electrolysis was performed in the same manner as in Experiment 3 except that the cathode potential was set to constant voltage of −2.1 V. After the completion of electrolysis, a gas in the gas feed pipe 2 was collected and subjected to gas chromatography analysis (carrier gas: nitrogen) in the same manner as in Experiment 3.

Experiment 5

Electrolysis was performed in the same manner as in Experiment 3 except that the cathode potential was set to constant voltage of −2.5 V. After the completion of electrolysis, a gas in the gas feed pipe 2 was collected and subjected to gas chromatography analysis (carrier gas: nitrogen) in the same manner as in Experiment 3.

Experiment 6

Electrolysis was performed in the same manner as in Experiment 3 except that the cathode potential was set to constant voltage of −2.8 V. After the completion of electrolysis, a gas in the gas feed pipe 2 was collected and subjected to gas chromatography analysis (carrier gas: nitrogen) in the same manner as in Experiment 3.

Experiment 7

Electrolysis was performed in the same manner as in Experiment 3 except that the cathode potential was set to constant voltage of −3.1 V. After the completion of electrolysis, a gas in the gas feed pipe 2 was collected and subjected to gas chromatography analysis (carrier gas: nitrogen) in the same manner as in Experiment 3.

Figure 5:
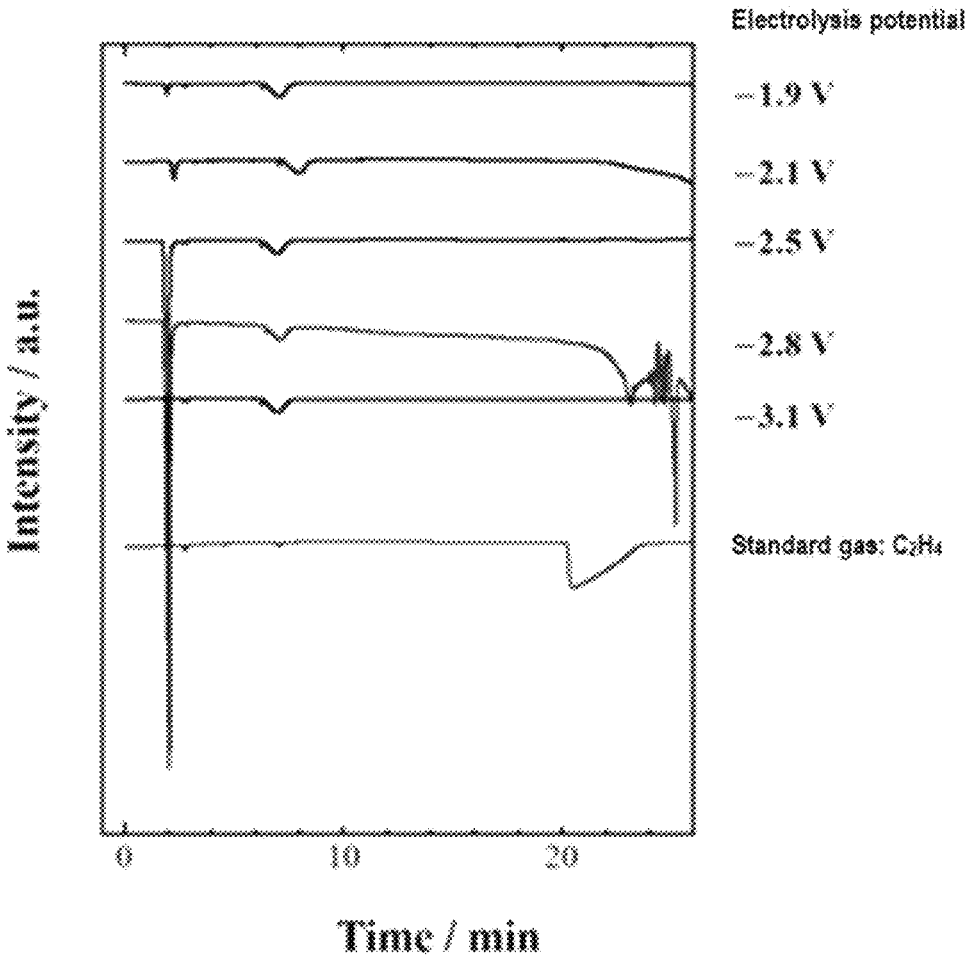
FIG. 5 is a diagram showing, in comparison with standard gases, a chromatogram obtained by the gas chromatography analysis of a gas generated on the cathode side during electrolytic reduction carried out using electrolytic solution B.

FIG. 5 shows chromatograms obtained by gas chromatography analysis in Experiments 3 to 7 described above, in comparison with chromatograms of hydrogen, carbon dioxide, and an ethylene gas serving as reference gases. As shown in FIG. 5, the same peak as the peaks of hydrogen and carbon dioxide was found in Experiments 3, 4, 5, and 7 using −1.9 V, −2.1 V, −2.5 V, and −3.1 V, respectively, as the cathode potential. On the other hand, the same peak as the peaks of hydrogen and carbon dioxide as well as a peak at the same position as that of the peak of an ethylene gas was found in Experiment 6 using −2.8 V as the cathode potential. These results demonstrated that in electrolytic reduction using the electrolytic solution B, ethylene can be selectively obtained with high efficiency by adjusting the potential to be applied.

Example 5

Experiment 8

Figure 6:
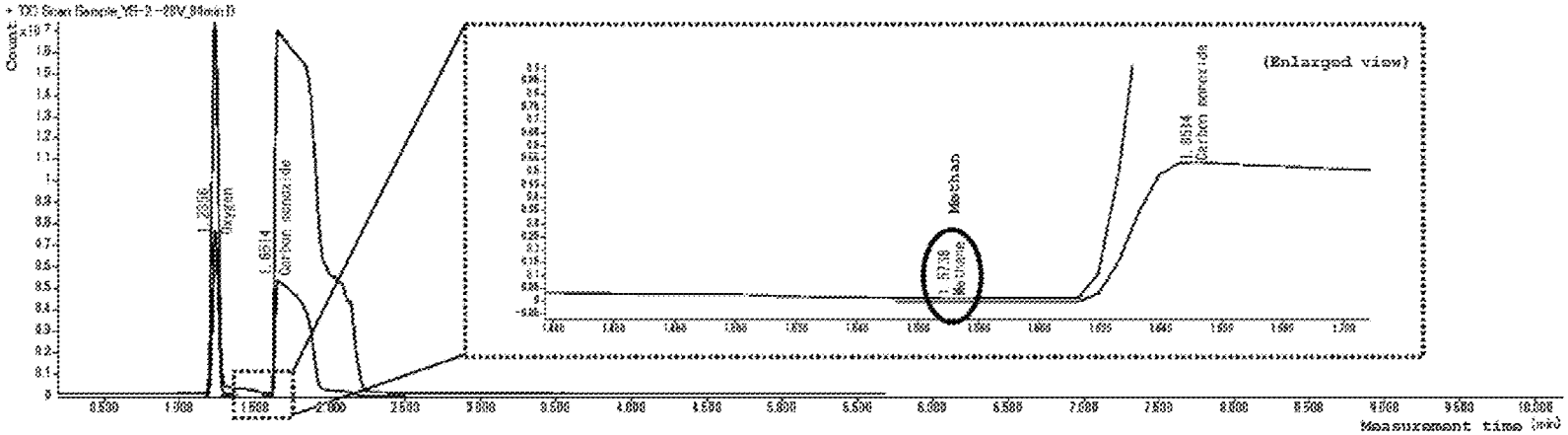
FIG. 6 is a diagram showing a chromatogram obtained by the gas chromatography analysis of a gas generated on the cathode side during electrolytic reduction carried out at a cathode potential of −2.3 V using electrolytic solution B.

Carbon dioxide was bubbled into the electrolytic solution A in the electrolyzer 1 in the same manner as in Example 1. Then, the cathode potential was set to constant voltage of −2.3 V, and in this state, electrolysis was performed for 30 minutes. After the completion of electrolysis, a needle of syringe 6 was inserted into the first branched pipe part 21 from rubber stopper 5 of the first branched pipe part 21, and a gas in the gas feed pipe 2 was collected and subjected to gas chromatography analysis (carrier gas: nitrogen). The obtained gas chromatogram is shown in FIG. 6.

Experiment 9

Electrolysis was performed in the same manner as in Experiment 8 except that the cathode potential was set to constant voltage of −2.5 V. After the completion of electrolysis, a gas in the gas feed pipe 2 was collected and subjected to gas chromatography analysis (carrier gas: nitrogen) in the same manner as in Experiment 8. The obtained gas chromatogram is shown in FIG. 7.

Experiment 10

Electrolysis was performed in the same manner as in Experiment 8 except that the cathode potential was set to constant voltage of −2.7 V. After the completion of electrolysis, a gas in the gas feed pipe 2 was collected and subjected to gas chromatography analysis (carrier gas: nitrogen) in the same manner as in Experiment 8. The obtained gas chromatogram is shown in FIG. 8.

Figure 7:
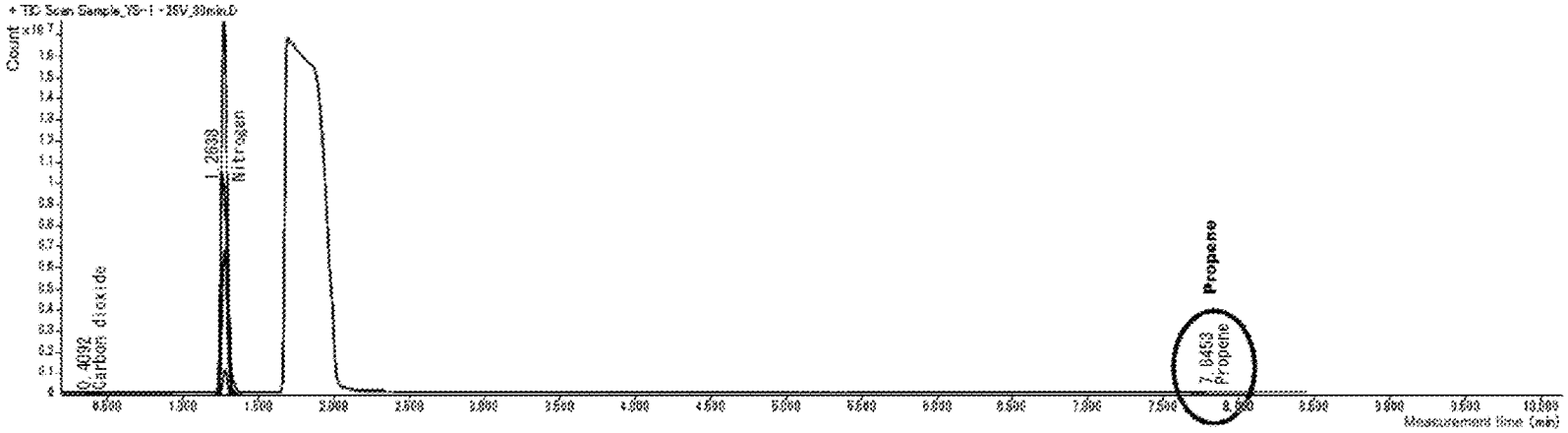
FIG. 7 is a diagram showing a chromatogram obtained by the gas chromatography analysis of a gas generated on the cathode side during electrolytic reduction carried out at a cathode potential of −2.5 V using electrolytic solution B.
Figure 8:
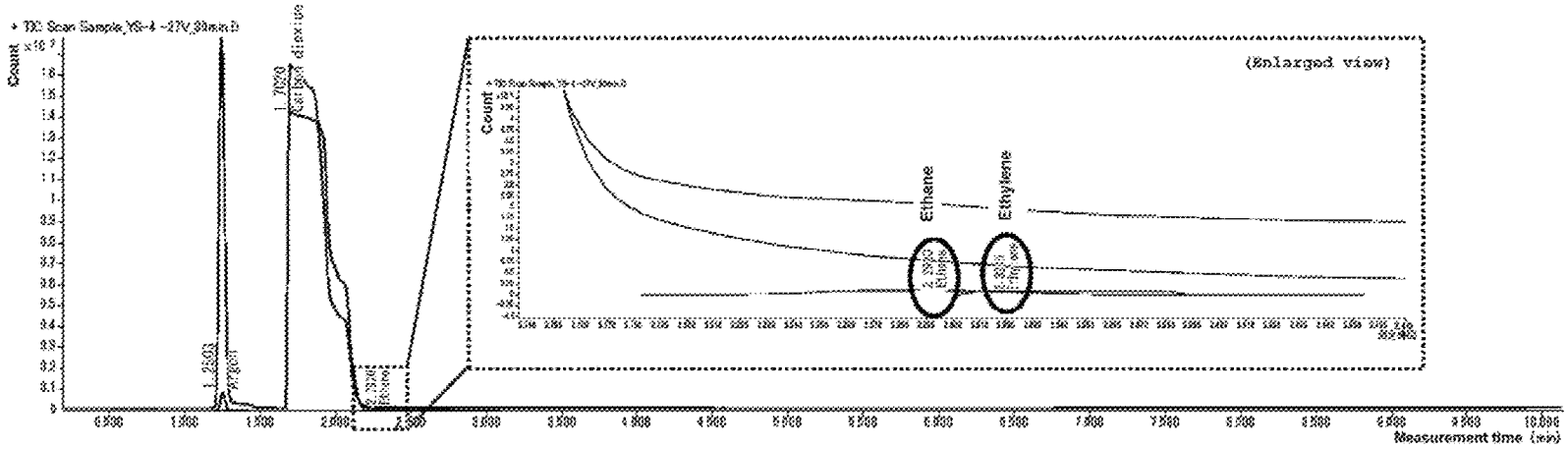
FIG. 8 is a diagram showing a chromatogram obtained by the gas chromatography analysis of a gas generated on the cathode side during electrolytic reduction carried out at a cathode potential of −2.7 V using electrolytic solution B.

The chromatograms of FIGS. 6 to 8 obtained by gas chromatography analysis in Experiments 8 to 10 described above were compared with the chromatograms of hydrogen, carbon dioxide, a methane gas, an ethane gas, an ethylene gas, and a propene gas serving as reference gases. As a result, the same peak as the peaks of hydrogen and carbon dioxide as well as a peak at the same position as that of the peak of a methane gas was found in Experiment 8 using −2.3 V as the cathode potential. The same peak as the peaks of hydrogen and carbon dioxide as well as a peak at the same position as that of the peak of a propene gas was found in Experiment 9 using −2.5 V as the cathode potential. The same peak as the peaks of hydrogen and carbon dioxide as well as peaks at the same positions as those of the peaks of an ethane gas and an ethylene gas were found in Experiment 10 using −2.7 V as the cathode potential. These results demonstrated that in electrolytic reduction using the electrolytic solution A, methane, ethane, ethylene, and propene can be selectively obtained with high efficiency by adjusting the potential to be applied.

Example 6

Experiment 11

Figure 9:
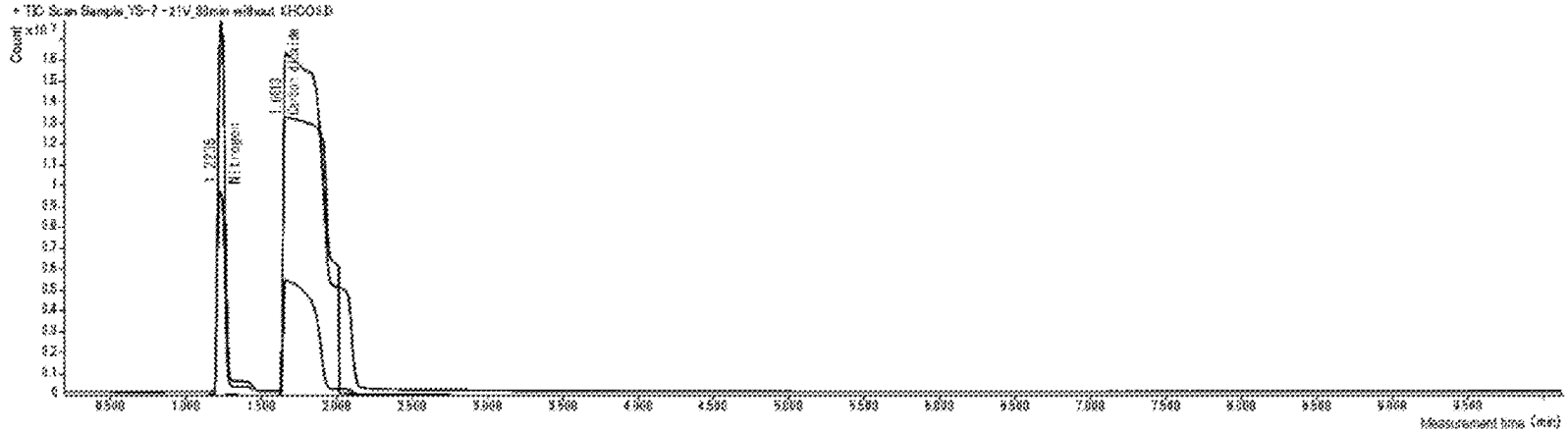
FIG. 9 is a diagram showing a chromatogram obtained by the gas chromatography analysis of a gas generated on the cathode side during electrolytic reduction carried out at a cathode potential of −2.1 V using electrolytic solution C.

An ionic liquid DEME-$BF_4$ and water were mixed at a capacity ratio of 50:50 to obtain electrolytic solution C. The obtained electrolytic solution C was added to the electrolyzer in the same manner as in Example 1, and carbon dioxide was bubbled thereinto. Subsequently, the cathode potential was set to constant voltage of −2.1 V, and in this state, electrolysis was performed for 30 minutes. After the completion of electrolysis, a needle of syringe 6 was inserted into the first branched pipe part 21 from rubber stopper 5 of the first branched pipe part 21, and a gas in the gas feed pipe 2 was collected and subjected to gas chromatography analysis (carrier gas: nitrogen). The obtained gas chromatogram is shown in FIG. 9.

Experiment 12

Figure 10:
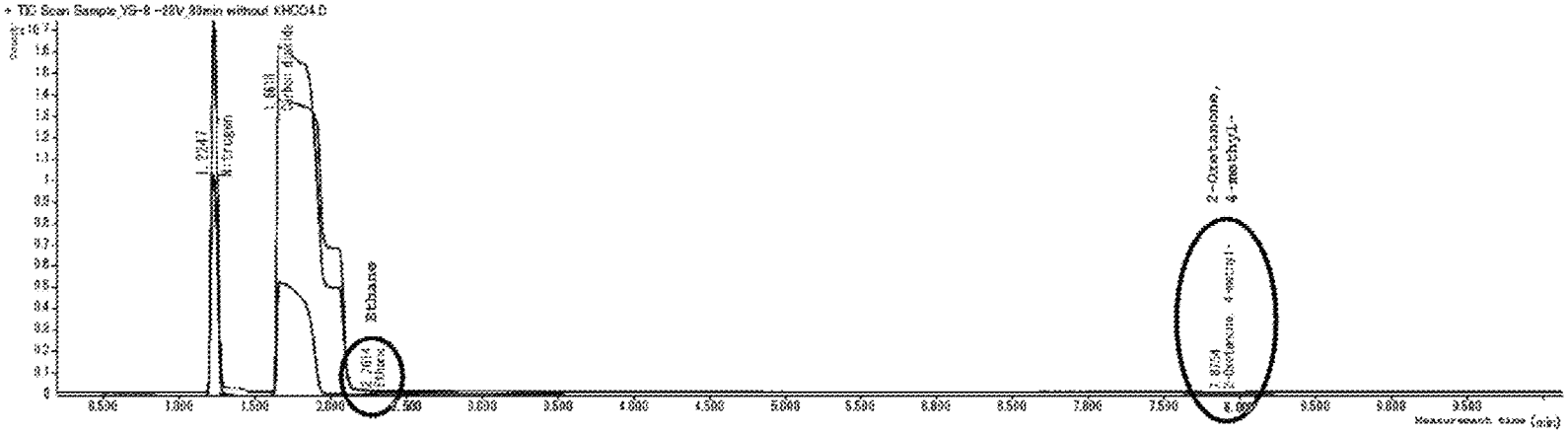
FIG. 10 is a diagram showing a chromatogram obtained by the gas chromatography analysis of a gas generated on the cathode side during electrolytic reduction carried out at a cathode potential of −2.3 V using electrolytic solution C.

Electrolysis was performed in the same manner as in Experiment 11 except that the cathode potential was set to constant voltage of −2.3 V. After the completion of electrolysis, a gas in the gas feed pipe 2 was collected and subjected to gas chromatography analysis (carrier gas: nitrogen) in the same manner as in Experiment 11. The obtained gas chromatogram is shown in FIG. 10.

Experiment 13

Figure 11:
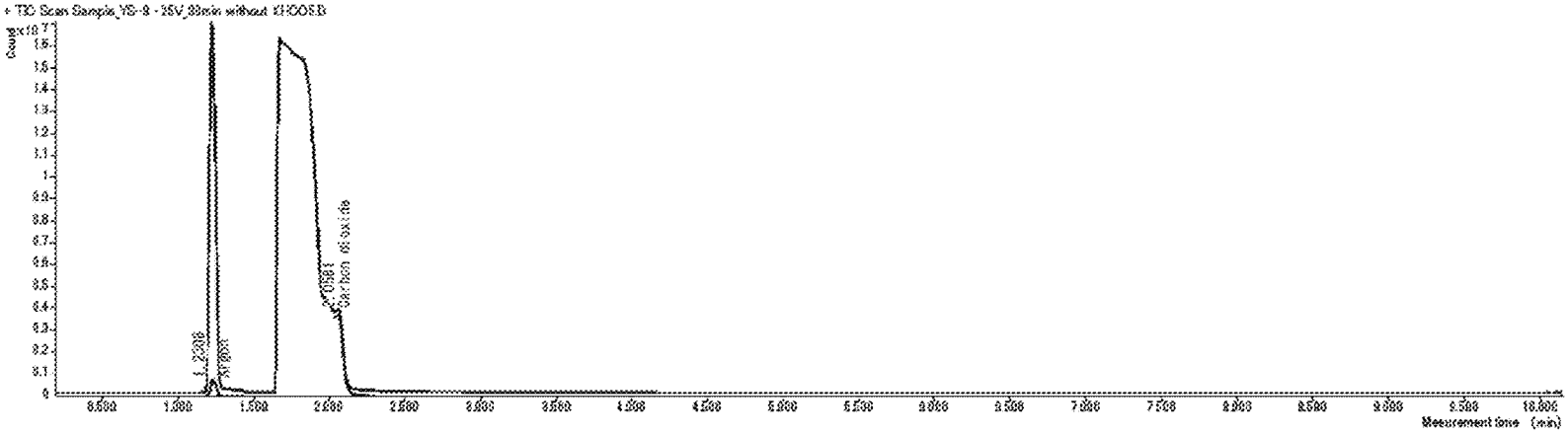
FIG. 11 is a diagram showing a chromatogram obtained by the gas chromatography analysis of a gas generated on the cathode side during electrolytic reduction carried out at a cathode potential of −2.5 V using electrolytic solution C.

Electrolysis was performed in the same manner as in Experiment 11 except that the cathode potential was set to constant voltage of −2.5 V. After the completion of electrolysis, a gas in the gas feed pipe 2 was collected and subjected to gas chromatography analysis (carrier gas: nitrogen) in the same manner as in Experiment 11. The obtained gas chromatogram is shown in FIG. 11.

Experiment 14

Figure 12:
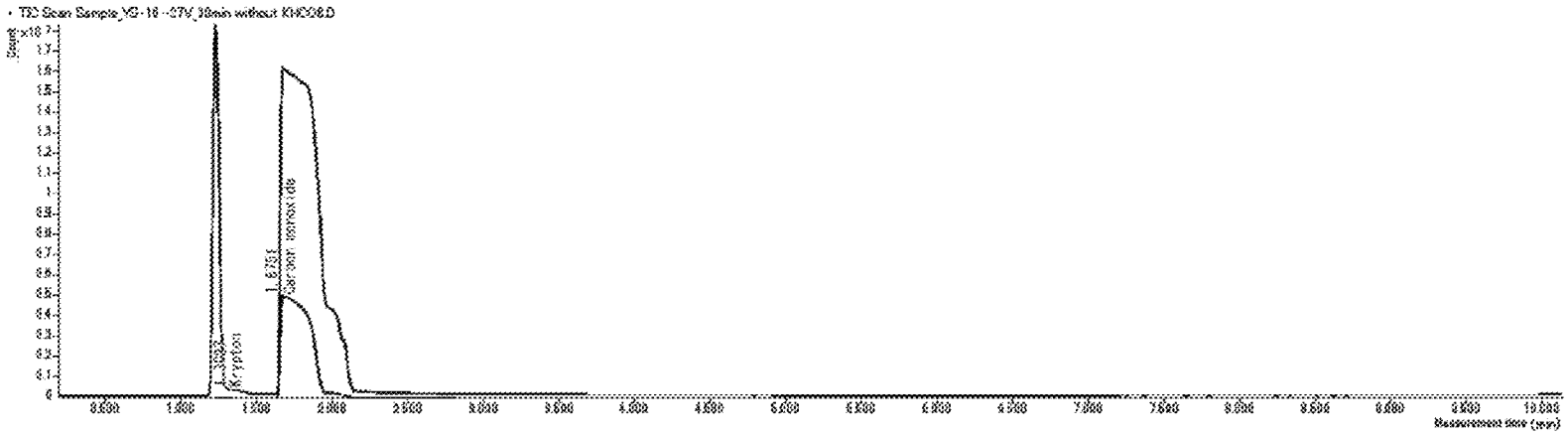
FIG. 12 is a diagram showing a chromatogram obtained by the gas chromatography analysis of a gas generated on the cathode side during electrolytic reduction carried out at a cathode potential of −2.7 V using electrolytic solution C.

Electrolysis was performed in the same manner as in Experiment 11 except that the cathode potential was set to constant voltage of −2.7 V. After the completion of electrolysis, a gas in the gas feed pipe 2 was collected and subjected to gas chromatography analysis (carrier gas: nitrogen) in the same manner as in Experiment 11. The obtained gas chromatogram is shown in FIG. 12.

The chromatograms obtained by gas chromatography analysis in Experiments 11 to 14 described above were compared with the chromatograms of hydrogen, carbon dioxide, a methane gas, an ethane gas, and a 4-methyl-2-oxetanone gas serving as reference gases. As a result, the same peak as the peaks of hydrogen and carbon dioxide was found in Experiments 11, 13, and 14 using −2.1 V, −2.5 V, and −2.7 V, respectively, as the cathode potential. On the other hand, the same peak as the peaks of hydrogen and carbon dioxide as well as peaks at the same positions as those of the peaks of a methane gas, an ethane gas, and a 4-methyl-2-oxetanone gas were found in Experiment 12 using −2.5 V as the cathode potential. These results demonstrated that in electrolytic reduction using the electrolytic solution C, methane, ethane, and 4-methyl-2-oxetanone can be selectively obtained with high efficiency by adjusting the potential to be applied.

Example 7

Experiment 15

An ionic liquid DEME-$BF_4$, water, and $Ca(OH)_2$ were mixed at a molar ratio of $2.0:1.0:1.8\times10^{-4}$ to obtain electrolytic solution D. The obtained electrolytic solution D was added to the electrolyzer in the electrolysis apparatus using a Cu plate electrode as the working electrode WE in the same manner as in Example 1, and carbon dioxide was bubbled thereinto. Subsequently, the cathode potential was set to constant voltage of −2.05 V, and in this state, electrolysis was performed for 30 minutes. After the completion of electrolysis, a needle of syringe 6 was inserted into the first branched pipe part 21 from rubber stopper 5 of the first branched pipe part 21, and a gas in the gas feed pipe 2 was collected and subjected to gas chromatography analysis (carrier gas: nitrogen). The analysis results are shown in Table 1 below.

Faraday efficiency e can be calculated as follows.

First, the volume ratio of an organic compound contained in the recovered gas is calculated from the total area of peaks obtained from GC-MS analysis, and a calibration curve. Subsequently, the volume of the produced organic compound is calculated from a volume occupied by a gas phase in a recovery container, and the calculated volume ratio of the organic compound to the gas. Finally, assuming that the generated organic compound is in a standard state, faraday efficiency e (%) is calculated according to the following expression.

[Expression 1]

$$E\,[\%] = \frac{\text{Actually measured amount of the organic compound produced [mol]}}{\text{Theoretical amount of the organic compound produced, determined from the quantity of electricity [mol]}} \times 100 =$$

$$\frac{\dfrac{\text{Calculated volume of the produced organic compound } [L]}{\text{Volume of the organic compound in a standard state (22.4) } [L/\text{mol}]}}{\dfrac{\text{Average current value during electrolysis } [A] \times \text{Electrolysis time [s]}}{\text{Faraday constant (96485) } [\text{C/mol}] \times \text{The number of electrons of the organic compound } [-]}} \times 100$$

Experiment 16

Electrolysis was performed in the same manner as in Experiment 15 except that the cathode potential was set to constant voltage of −2.85 V. After the completion of electrolysis, a gas in the gas feed pipe 2 was collected and subjected to gas chromatography analysis (carrier gas: nitrogen) in the same manner as in Experiment 15. The analysis results are shown in Table 1 below.

Experiment 17

Electrolysis was performed in the same manner as in Experiment 15 except that the cathode potential was set to constant voltage of −2.55 V and an Fe plate electrode was used as the working electrode WE. After the completion of electrolysis, a gas in the gas feed pipe 2 was collected and subjected to gas chromatography analysis (carrier gas: nitrogen) in the same manner as in Experiment 15. The analysis results are shown in Table 1 below.

Experiment 18

Electrolysis was performed in the same manner as in Experiment 15 except that the cathode potential was set to constant voltage of −2.50 V and a Ag plate electrode was used as the working electrode WE. After the completion of electrolysis, a gas in the gas feed pipe 2 was collected and subjected to gas chromatography analysis (carrier gas: nitrogen) in the same manner as in Experiment 15. The analysis results are shown in Table 1 below.

Example 8

Experiment 19

An ionic liquid DEME-$BF_4$, water, and $Ca(OH)_2$ were mixed at a molar ratio of $1.0:2.0:1.8\times10^{-4}$ to obtain electrolytic solution E. The obtained electrolytic solution E was added to the electrolyzer in the electrolysis apparatus using a Cu plate electrode as the working electrode WE in the same manner as in Example 1, and carbon dioxide was bubbled thereinto. Subsequently, the cathode potential was set to constant voltage of −1.80 V, and in this state, electrolysis was performed for 30 minutes. After the completion of electrolysis, a needle of syringe 6 was inserted into the first branched pipe part 21 from rubber stopper 5 of the first branched pipe part 21, and a gas in the gas feed pipe 2 was collected and subjected to gas chromatography analysis (carrier gas: nitrogen). The analysis results are shown in Table 1 below.

Example 9

Experiment 20

An ionic liquid DEME-$BF_4$, water, and KOH were mixed at a molar ratio of 2:1:0.001 to obtain electrolytic solution F. The obtained electrolytic solution F was added to the electrolyzer in the electrolysis apparatus using a Cu plate electrode as the working electrode WE in the same manner as in Example 1, and carbon dioxide was bubbled thereinto. Subsequently, the cathode potential was set to constant voltage of −1.76 V, and in this state, electrolysis was performed for 30 minutes. After the completion of electrolysis, a needle of syringe 6 was inserted into the first branched pipe part 21 from rubber stopper 5 of the first branched pipe part 21, and a gas in the gas feed pipe 2 was collected and subjected to gas chromatography analysis (carrier gas: nitrogen). The analysis results are shown in Table 1 below.

Experiment 21

Electrolysis was performed in the same manner as in Experiment 20 except that the cathode potential was set to constant voltage of −2.16 V. After the completion of electrolysis, a gas in the gas feed pipe 2 was collected and subjected to gas chromatography analysis (carrier gas: nitrogen) in the same manner as in Experiment 20. The analysis results are shown in Table 1 below.

Example 10

Experiment 22

An ionic liquid DEME-$BF_4$, water, and CsOH were mixed at a molar ratio of $2.0:1.0:3.7\times10^{-3}$ to obtain electrolytic solution G. The obtained electrolytic solution G was added to the electrolyzer in the electrolysis apparatus using a Ag plate electrode as the working electrode WE in the same manner as in Example 1, and carbon dioxide was bubbled thereinto. Subsequently, the cathode potential was set to constant voltage of −2.55 V, and in this state, electrolysis was performed for 30 minutes. After the completion of electrolysis, a needle of syringe 6 was inserted into the first branched pipe part 21 from rubber stopper 5 of the first branched pipe part 21, and a gas in the gas feed pipe 2 was collected and subjected to gas chromatography analysis (carrier gas: nitrogen). The analysis results are shown in Table 1 below.

Example 11

Experiment 23

An ionic liquid DEME-$BF_4$ and water were mixed at a molar ratio of 10:1 to obtain electrolytic solution H. The obtained electrolytic solution H was added to the electrolyzer in the electrolysis apparatus using a Cu plate electrode as the working electrode WE in the same manner as in Example 1, and carbon dioxide was bubbled thereinto. Subsequently, the cathode potential was set to constant voltage of −1.85 V, and in this state, electrolysis was performed for 30 minutes. After the completion of electrolysis, a needle of syringe 6 was inserted into the first branched pipe part 21 from rubber stopper 5 of the first branched pipe part 21, and a gas in the gas feed pipe 2 was collected and subjected to gas chromatography analysis (carrier gas: nitrogen). The analysis results are shown in Table 1 below.

Experiment 24

Electrolysis was performed in the same manner as in Experiment 23 except that the cathode potential was set to constant voltage of −2.45 V. After the completion of electrolysis, a gas in the gas feed pipe 2 was collected and subjected to gas chromatography analysis (carrier gas: nitrogen) in the same manner as in Experiment 23. The analysis results are shown in Table 1 below.

Example 12

Experiment 25

An ionic liquid DEME-$BF_4$ and water were mixed at a molar ratio of 20:1 to obtain electrolytic solution I. The obtained electrolytic solution I was added to the electrolyzer in the electrolysis apparatus using a Cu plate electrode as the working electrode WE in the same manner as in Example 1, and carbon dioxide was bubbled thereinto. Subsequently, the cathode potential was set to constant voltage of −1.96 V, and in this state, electrolysis was performed for 30 minutes. After the completion of electrolysis, a needle of syringe 6 was inserted into the first branched pipe part 21 from rubber stopper 5 of the first branched pipe part 21, and a gas in the gas feed pipe 2 was collected and subjected to gas chromatography analysis (carrier gas: nitrogen). The analysis results are shown in Table 1 below.

TABLE 1

| | Faraday efficiency (%) | | | | |
|---|---|---|---|---|---|
| Experiment | Acetone | Toluene | Ethylene | Ethane | Hydrogen |
| 15 | 19.10 | 0.55 | 0.05 | — | 80.94 |
| 16 | 2.34 | 0.06 | 0.43 | — | 53.88 |
| 17 | 3.98 | 0.52 | 0.04 | — | 95.99 |
| 18 | 2.98 | 1.98 | — | — | 30.40 |
| 19 | 3.76 | — | — | — | — |
| 20 | 3.38 | — | 0.12 | — | — |
| 21 | 1.72 | — | — | — | — |
| 22 | 1.62 | — | — | — | 6.74 |
| 23 | 2.32 | — | 0.56 | — | — |
| 24 | 7.69 | — | 0.09 | — | — |
| 25 | 1.42 | — | 4.63 | 0.61 | — |

Example 13

Experiment 26

An ionic liquid DEME-$BF_4$, water, and CsOH were mixed at a molar ratio of $10:1.0:4.0\times10^{-4}$ to obtain electrolytic solution J. The obtained electrolytic solution J was added to the electrolyzer in the electrolysis apparatus using a Ag plate electrode as the working electrode WE in the same manner as in Example 1, and carbon dioxide was bubbled thereinto. Subsequently, the cathode potential was set to constant voltage of −2.65 V, and in this state, electrolysis was performed for 30 minutes. After the completion of electrolysis, a needle of syringe 6 was inserted into the first branched pipe part 21 from rubber stopper 5 of the first branched pipe part 21, and a gas in the gas feed pipe 2 was collected and subjected to gas chromatography analysis (carrier gas: nitrogen). The analysis results are shown in Table 2 below.

Example 14

Experiment 27

An ionic liquid DEME-$BF_4$, water, and NaOH were mixed at a molar ratio of $2.0:1.0:1.8\times10^{-4}$ to obtain electrolytic solution K. The obtained electrolytic solution K was added to the electrolyzer in the electrolysis apparatus using a Ag plate electrode as the working electrode WE in the same manner as in Example 1, and carbon dioxide was bubbled thereinto. Subsequently, the cathode potential was set to constant voltage of −3.00 V, and in this state, electrolysis was performed for 30 minutes. After the completion of electrolysis, a needle of syringe 6 was inserted into the first branched pipe part 21 from rubber stopper 5 of the first branched pipe part 21, and a gas in the gas feed pipe 2 was collected and subjected to gas chromatography analysis (carrier gas: nitrogen). The analysis results are shown in Table 2 below.

Example 15

Experiment 28

An ionic liquid DEME-$BF_4$, water, and CsOH were mixed at a molar ratio of $1.0:2.0:7.5\times10^{-4}$ to obtain electrolytic solution L. The obtained electrolytic solution L was added to the electrolyzer in the electrolysis apparatus using a Cu plate electrode as the working electrode WE in the same manner as in Example 1, and carbon dioxide was bubbled thereinto. Subsequently, the cathode potential was set to constant voltage of −2.00 V, and in this state, electrolysis was performed for 30 minutes. After the completion of electrolysis, a needle of syringe 6 was inserted into the first branched pipe part 21 from rubber stopper 5 of the first branched pipe part 21, and a gas in the gas feed pipe 2 was collected and subjected to gas chromatography analysis (carrier gas: nitrogen). The analysis results are shown in Table 2 below.

Example 16

Experiment 29

An ionic liquid DEME-$BF_4$, water, and CsOH were mixed at a molar ratio of $10:1.0:4.2\times10^{-4}$ to obtain electrolytic solution M. The obtained electrolytic solution M was added to the electrolyzer in the electrolysis apparatus using a Ag plate electrode as the working electrode WE in the same manner as in Example 1, and carbon dioxide was bubbled thereinto. Subsequently, the cathode potential was set to constant voltage of −1.95 V, and in this state, electrolysis was performed for 30 minutes. After the completion of electrolysis, a needle of syringe 6 was inserted into the first branched pipe part 21 from rubber stopper 5 of the first branched pipe part 21, and a gas in the gas feed pipe 2 was collected and subjected to gas chromatography analysis (carrier gas: nitrogen). The analysis results are shown in Table 2 below.

Example 17

Experiment 30

Electrolysis was performed in the same manner as in Experiment 29 except that the cathode potential was set to constant voltage of −2.75 V. After the completion of electrolysis, a gas in the gas feed pipe 2 was collected and subjected to gas chromatography analysis (carrier gas: nitrogen) in the same manner as in Experiment 29. The analysis results are shown in Table 2 below.

Example 18

Experiment 31

An ionic liquid DEME-$BF_4$, water, and NaOH were mixed at a molar ratio of $2.1:2.0:2.0\times10^{-3}$ to obtain electrolytic solution N. The obtained electrolytic solution N was added to the electrolyzer in the electrolysis apparatus using a Ag plate electrode as the working electrode WE in the same manner as in Example 1, and carbon dioxide was bubbled thereinto. Subsequently, the cathode potential was set to constant voltage of −2.80 V, and in this state, electrolysis was performed for 30 minutes. After the completion of electrolysis, a needle of syringe 6 was inserted into the first branched pipe part 21 from rubber stopper 5 of the first branched pipe part 21, and a gas in the gas feed pipe 2 was collected and subjected to gas chromatography analysis (carrier gas: nitrogen). The analysis results are shown in Table 2 below.

Example 19

Experiment 32

An ionic liquid DEME-$BF_4$, water, and LiOH were mixed at a molar ratio of $2.0:1.0:4.0\times10^{-3}$ to obtain electrolytic solution O. The obtained electrolytic solution O was added to the electrolyzer in the electrolysis apparatus using a Ag plate electrode as the working electrode WE in the same manner as in Example 1, and carbon dioxide was bubbled thereinto. Subsequently, the cathode potential was set to constant voltage of −2.40 V, and in this state, electrolysis was performed for 30 minutes. After the completion of electrolysis, a needle of syringe 6 was inserted into the first branched pipe part 21 from rubber stopper 5 of the first branched pipe part 21, and a gas in the gas feed pipe 2 was collected and subjected to gas chromatography analysis (carrier gas: nitrogen). The analysis results are shown in Table 2 below.

Example 20

Experiment 33

Electrolysis was performed in the same manner as in Experiment 32 except that the cathode potential was set to constant voltage of −3.05 V. After the completion of electrolysis, a gas in the gas feed pipe 2 was collected and subjected to gas chromatography analysis (carrier gas: nitrogen) in the same manner as in Experiment 32. The analysis results are shown in Table 2 below.

Example 21

Experiment 34

An ionic liquid DEME-$BF_4$, water, and $Ca(OH)_2$ were mixed at a molar ratio of $2.0:1.0:2.0\times10^{-4}$ to obtain electrolytic solution P. The obtained electrolytic solution P was added to the electrolyzer in the electrolysis apparatus using a Cu plate electrode as the working electrode WE in the same manner as in Example 1, and carbon dioxide was bubbled thereinto. Subsequently, the cathode potential was set to constant voltage of −2.70 V, and in this state, electrolysis was performed for 30 minutes. After the completion of electrolysis, a needle of syringe 6 was inserted into the first branched pipe part 21 from rubber stopper 5 of the first branched pipe part 21, and a gas in the gas feed pipe 2 was collected and subjected to gas chromatography analysis (carrier gas: nitrogen). The analysis results are shown in Table 2 below.

Example 22

Experiment 35

An ionic liquid DEME-$BF_4$, water, and $Ca(OH)_2$ were mixed at a molar ratio of $2.0:1.0:2.0\times10^{-4}$ to obtain electrolytic solution P. The obtained electrolytic solution P was added to the electrolyzer in the electrolysis apparatus using a Ag plate electrode as the working electrode WE in the same manner as in Example 1, and carbon dioxide was bubbled thereinto. Subsequently, the cathode potential was set to constant voltage of −2.60 V, and in this state, electrolysis was performed at 80° C. for 30 minutes. After the completion of electrolysis, a needle of syringe 6 was inserted into the first branched pipe part 21 from rubber stopper 5 of the first branched pipe part 21, and a gas in the gas feed pipe 2 was collected and subjected to gas chromatography analysis (carrier gas: nitrogen). The analysis results are shown in Table 2 below.

Example 23

Experiment 36

Electrolysis was performed in the same manner as in Experiment 35 except that the cathode potential was set to constant voltage of −3.05 V. After the completion of electrolysis, a gas in the gas feed pipe 2 was collected and subjected to gas chromatography analysis (carrier gas: nitrogen) in the same manner as in Experiment 35. The analysis results are shown in Table 2 below.

Example 24

Experiment 37

An ionic liquid $P_{2225}$TFSI (triethylpentylphosphonium bis(trifluoromethanesulfonyl)imide) was used as electrolytic solution Q as it was. The electrolytic solution Q was added to the electrolyzer in the electrolysis apparatus using a Ag plate electrode as the working electrode WE in the same manner as in Example 1, and carbon dioxide was bubbled thereinto. Subsequently, the cathode potential was set to constant voltage of −3.20 V, and in this state, electrolysis was performed for 60 minutes. After the completion of electrolysis, a needle of syringe 6 was inserted into the first branched pipe part 21 from rubber stopper 5 of the first branched pipe part 21, and a gas in the gas feed pipe 2 was collected and subjected to gas chromatography analysis (carrier gas: nitrogen). The analysis results are shown in Table 2 below.

Example 25

Experiment 38

Electrolysis was performed in the same manner as in Experiment 37 except that the cathode potential was set to constant voltage of −2.85 V. After the completion of electrolysis, a gas in the gas feed pipe 2 was collected and subjected to gas chromatography analysis (carrier gas: nitrogen) in the same manner as in Experiment 37. The analysis results are shown in Table 2 below.

TABLE 2

| Faraday efficiency | Experiment | | | | | | | | | | | | |
|---|---|---|---|---|---|---|---|---|---|---|---|---|---|
| (%) | 26 | 27 | 28 | 29 | 30 | 31 | 32 | 33 | 34 | 35 | 36 | 37 | 38 |
| Methanol | — | — | — | 12.37 | 0.08 | — | 0.1 | 0.03 | 0.27 | — | — | — | — |
| Ethanol | 48.1 | — | 3.72 | 37.75 | 26.04 | 5.31 | 50.05 | 1.15 | — | 5.67 | 1.58 | — | — |
| Carbon monoxide | 27.23 | 69.93 | 81.38 | 10.48 | 14.76 | 80.57 | 7.1 | 96.21 | 55.38 | tr | 45.62 | 61.8 | 64.5 |
| Ethylene | 0.08 | 0.03 | 0.04 | 0.02 | 0.04 | 0.05 | 0.04 | 0.02 | 0.14 | 0.12 | 3.04 | — | — |
| Ethane | — | 0.01 | — | 0.01 | 0.12 | 0.09 | 0.04 | 0.01 | 0.04 | 0.03 | 1.38 | — | — |
| Propylene | — | — | — | 0.01 | — | 0.01 | — | — | 0.01 | — | — | — | — |
| Propane | — | — | — | 0.09 | — | 0.05 | — | — | 0.02 | — | — | — | — |
| Butane | — | — | — | 0.73 | — | 0.15 | — | — | — | 10.86 | 4.25 | — | — |
| Acetone | — | — | — | 2.05 | 1.1 | 1.58 | 25.58 | 2.49 | 0.28 | 0.39 | 0.22 | — | — |
| Toluene | — | — | — | — | — | — | — | — | 2.72 | 0.14 | — | — | — |
| Formaldehyde | — | — | — | — | — | 2.39 | 8.57 | — | — | — | — | — | — |
| Acetaldehyde | — | — | — | 8.78 | 0.05 | 0.17 | 0.11 | 0.02 | 0.05 | 0.79 | 0.39 | — | — |
| Hydrogen | 20.55 | 7.66 | 14.57 | 38.01 | 24.22 | 18.21 | 7.5 | 0.02 | 30.53 | 19.17 | 7.18 | — | — |

INDUSTRIAL APPLICABILITY

The electrolytic reduction method of the present disclosure can convert carbon dioxide responsible for global warming, etc. into useful carbon monoxide, organic compound, or the like and as such, is useful in various fields, particularly, in the environmental field.

REFERENCE SIGNS LIST

1 . . . Electrolyzer
2 . . . Gas supply pipe
3 . . . Exhaust pipe
4 . . . Conductor wire
5 . . . Rubber stopper
6 . . . Syringe
7 . . . Electrolytic solution
11 . . . Cell body
12 . . . Lid
21 . . . First branched pipe part
22 . . . Second branched pipe part
23 . . . Enlarged diameter part

What is claimed is:

1. A method for manufacturing an organic compound, comprising electrolytically reducing carbon dioxide to obtain an organic compound in an electrolytic reduction apparatus having an anode electrode, a cathode electrode, and an electrolytic solution containing carbon dioxide, wherein the organic compound is butane, acetone, or an aromatic compound, the electrolytic solution includes an ionic liquid and water, the ionic liquid is an ammonium-based ionic liquid, and carbon dioxide is selectively reduced into butane, acetone, or an aromatic compound by a potential to be applied to between the anode electrode and the cathode electrode.

2. The method for manufacturing an organic compound according to claim 1, wherein the ionic liquid is N,N-diethyl-N-(2-methoxyethyl)ammonium tetrafluoroborate or N,N-diethyl-N-methyl-N-(2-methoxyethyl)ammonium bis(trifluoromethanesulfonyl)imide.

3. The method for manufacturing an organic compound according to claim 1, wherein the electrolytic solution comprises an additive.

4. The method for manufacturing an organic compound according to claim 3, wherein the additive comprises a supporting electrolyte or a basic catalyst.

5. The method for manufacturing an organic compound according to claim 4, wherein the supporting electrolyte is $KHCO_3$, $KHPO_4$, $LiBF_4$, $LiPF_6$, $LiClO_4$, $LiAsF_6$, LiTf, LiTFSI, $Li(CF_3SO_2)_2N$, $K_2CO_3$, $Li_2CO_3$, $Na_2CO_3$, or $NaHCO_3$.

6. The method for manufacturing an organic compound according to claim 4, wherein the supporting electrolyte is $KHCO_3$.

7. The method for manufacturing an organic compound according to claim 4, wherein a volume ratio between the ionic liquid and the total of water and the supporting electrolyte is 1:99 to 99:1.

8. The method for manufacturing an organic compound according to claim 4, wherein the basic catalyst is a hydroxide of an alkali metal or an alkaline earth metal.

9. The method for manufacturing an organic compound according to claim 4, wherein the basic catalyst is $Ca(OH)_2$, LiOH, NaOH, KOH, or CsOH.

10. The method for manufacturing an organic compound according to claim 1, wherein the electrolytic reduction apparatus further comprises a reference electrode, the reference electrode is a $Ag^+/Ag$ electrode, and a potential of the cathode electrode is −5.0 to −1.5 V.

11. The method for manufacturing an organic compound according to claim 1, wherein a temperature of the electrolytic solution is 0 to 100° C.

12. The method for manufacturing an organic compound according to claim 1, wherein the cathode electrode is a plate electrode.

13. The method for manufacturing an organic compound according to claim 1, wherein the anode electrode is a Pt, metal oxide, glassy carbon, or boron-doped diamond electrode, and the cathode electrode is a Cu, Ag, Fe, or Ni electrode.

14. The method for manufacturing an organic compound according to claim 1, wherein the cathode electrode is a Ag, Cu, or Fe electrode.

15. The method for manufacturing an organic compound according to claim 1, wherein the cathode electrode is a Ag, Cu, or Fe electrode, and the anode electrode is a Pt electrode.

16. The method for manufacturing an organic compound according to claim 1, wherein butane, acetone, or an aromatic compound is selectively produced by setting the potential of the cathode electrode at a specific corresponding value.

* * * * *